US006506528B1

(12) United States Patent
Owczarczyk et al.

(10) Patent No.: US 6,506,528 B1
(45) Date of Patent: Jan. 14, 2003

(54) PHOTOTHERMOGRAPHIC ELEMENT CONTAINING A MIXTURE OF BLOCKED DEVELOPERS

(75) Inventors: Zbyslaw R. Owczarczyk, Webster, NY (US); David T. Southby, Rochester, NY (US); Xiqiang Yang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 39 days.

(21) Appl. No.: 09/718,027

(22) Filed: Nov. 20, 2000

Related U.S. Application Data

(60) Provisional application No. 60/211,445, filed on Jun. 13, 2000.

(51) Int. Cl.[7] ..... G03C 1/498; G03C 11/00

(52) U.S. Cl. ..... 430/21; 430/351; 430/443; 430/448; 430/566; 430/619; 430/955; 430/959; 430/964

(58) Field of Search ..... 430/21, 351, 353, 430/380, 404, 443, 448, 495.1, 619, 618, 955, 959, 964, 566

(56) References Cited

U.S. PATENT DOCUMENTS 6,306,551 B1 * 10/2001 Owczarczk et al. ..... 430/21
6,319,640 B1 * 11/2001 Slusarek et al. ..... 430/21

OTHER PUBLICATIONS

USSN 09/475,703 filed Dec. 30, 1999, Imaging Element Containing A Blocked Photographically Useful Compound, Wojciech K. Slusarek, et al.

* cited by examiner

*Primary Examiner*—Thorl Chea
(74) *Attorney, Agent, or Firm*—Chris P. Konkol

(57) ABSTRACT

This invention relates to a photothermographic color element containing a mixture of blocked developers in the same emulsion layer, which blocked developers having different onset temperatures. Such a mixture has been found to allow for lower film processing temperatures and/or shorter times of development with respect to the blocked developer having a higher onset temperature. Conversely, improved discrimination can be obtained with respect to the blocked developer having the lower onset temperature.

36 Claims, 2 Drawing Sheets

PHOTOTHERMOGRAPHIC ELEMENT CONTAINING A MIXTURE OF BLOCKED DEVELOPERS

This application claims Benefit of Provisional application Ser. No. 60/211,445 filed Jun. 13, 2000.

FIELD OF THE INVENTION

A color photothermographic element containing a mixture of blocked developing agents provides a more robust system for thermal development. In particular, a mixture of at least two blocked developers having different onset temperatures can be used to allow for lower film processing temperatures and/or shorter times of development with respect to the blocked developer having a higher onset temperature, while obtaining improved discrimination with respect to the blocked developer having the lower discrimination. Also, a mixture of at least two blocked developers having different onset temperatures can be used to provide a more robust relative discrimination versus temperature curve.

BACKGROUND OF THE INVENTION

In conventional color photography, films containing light-sensitive silver halide are employed in hand-held cameras. Upon exposure, the film carries a latent image that is only revealed after suitable processing. These elements have historically been processed by treating the camera-exposed film with at least a developing solution having a developing agent that acts to form an image in cooperation with components in the film. Developing agents commonly used are reducing agents, for example, p-aminophenols or p-phenylenediamines.

Typically, developing agents (also herein referred to as developers) present in developer solutions are brought into reactive association with exposed photographic film elements at the time of processing. Segregation of the developer and the film element has been necessary because the incorporation of developers directly into sensitized photographic elements can lead to desensitization of the silver halide emulsion and undesirable fog. Considerable effort, however, has been directed to producing effective blocked developing agents (also referred to herein as blocked developers) that might be introduced into silver halide emulsion elements without deleterious desensitization or fog effects. Accordingly, blocked developing agents have been sought that would unblock under preselected conditions of development after which such developing agents would be free to participate in image-forming (dye or silver metal forming) reactions.

U.S. Pat. No. 3,342,599 to Reeves discloses the use of Schiff-base developer precursors. Schleigh and Faul, in a *Research Disclosure* (129 (1975) pp. 27–30), describes the quaternary blocking of color developers and the acetamido blocking of p-phenylenediamines. (All Research Disclosures referenced herein are published by Kenneth Mason Publications, Ltd., Dudley Annex, 12a North Street, Emsworth, Hampshire P010 7DQ, ENGLAND.) Subsequently, U.S. Pat. No. 4,157,915 to Hamaoka et al. and U.S. Pat. No. 4,060,418 to Waxman and Mourning describe the preparation and use of blocked p-phenylenediamines in an image-receiving sheet for color diffusion transfer. In addition to the aforementioned U.S. Pat. No. 4,157,915, blocked developing agents involving β-elimination reactions during unblocking have been disclosed in European Patent Application 393523 and kokais 57076453; 2131253; and 63123046, the latter specifically in the context of photothermographic elements.

All of these approaches have failed in practical product applications because of one or more of the following problems: desensitization of sensitized silver halide; unacceptably slow unblocking kinetics; instability of blocked developer yielding increased fog and/or decreased Dmax after storage, lack of simple methods for releasing the blocked developer, inadequate or poor image formation, and other problems. Especially in the area of photothermographic color films, other potential problems include poor discrimination and poor dye-forming activity.

Recent developments in blocking and switching chemistry have led to blocked developing agents, including p-phenylenediamines, that perform relatively well. In particular, compounds having "β-ketoester" type blocking groups (strictly, β-ketoacyl blocking groups) are described in U.S. Pat. No. 5,019,492. With the advent of the β-ketoester blocking chemistry, it has become possible to incorporate p-phenylenediamine developers in film systems in a form from which they only become active when required for development. The β-ketoacyl blocked developers are released from the film layers in which they are incorporated by an alkaline developing solution containing a dinucleophile, for example hydroxylamine.

It is an object of the invention to obtain improved color photothermographic imaging elements and methods for their development employing incorporated blocked developing agents, also referred to herein as blocked developers. With respect to color photothermographic imaging elements, it is desirable to employ a blocked developer that is stable until development yet can rapidly and easily develop a high quality image once processing has been initiated by heating the element or by applying to the element a processing solution during or after heating, such as a solution of a base or acid or pure water. A completely dry process or an apparently dry process (for example, in which the volume of aqueous solutions is small enough to be applied by a laminate) is most desirable and, in fact, the eliminating the application of all or most solutions and photochemical processing chemicals is one of the main advantages of a dry or apparently dry photothermographic system. The existence of such a process would allow for very rapidly processed films that can be processed simply and efficiently in photoprocessing kiosks. Such kiosks, with increased numbers and accessibility, could ultimately allow for, photofinishing in many new environments that have not previously been attempted. This in turn would lead to increased convenience for the consumer. One of the factors to be considered, with respect to a blocked developer in a color photothermographic element, is the onset temperature of the blocked developer, that is, the temperature at which the compound becomes substantially unblocked or activated, which is generally a measure or indication of the temperature at which the development process will need to be performed. In generally, other factors being equal, the higher the onset temperature, the higher the process temperature. A process at lower temperatures generally has less side reactions and is less expensive to accomplish. There is less potential deformation of the film base which can adversely affect image quality. Also, higher temperatures tend to undesirably decompose components in the photographic element and release volatile vapors.

Another factor to be considered, with respect to a blocked developer in a photothermographic element, is the relative discrimination of the image, generally defined as the difference of between Dmin and Dmax at a given process temperature divided by the Dmin. This parameter describes to ratio of photographic signal to fog level, and is generally desired to be high Since the discrimination of an image, using a blocked developer, will generally vary with process temperature, it is usually desirable to process the film at the temperature of peak discrimination (in the photographic element). It is further desirable that the film have a high peak discrimination. Discrimination of a film can be affected by a number of factors, including photographic emulsion type and finish, the kind and amount of couple, the thermal solvent, and other factors. However, a key factor is the blocked developing agent incorporated in the photothermographic film.

A problem with a blocked developer is that discrimination may be poor if the blocked developer unblocks to quickly or does not unblock quickly enough. It is advantageous to appropriately balance the reactivity of the developing agent, during developing, with the rate of release of the developing agent from the blocked developing agent. If the reactivity of developing agent with the coupling agent (or "coupler") to form the image dye is too much less than the rate of release of the developing agent, at a particular temperature, then there is the opportunity for side reactions to occur which may decrease the discrimination. (usually by increasing fog) and consequently decrease image quality. On the other hand, if the reactivity of the developing agent with the coupling agent is too much greater than the rate of release of the developing agent, at the temperature of development, then there may not be enough developing agent for image formation to occur which may also decrease discrimination (this time, usually by decreasing Dmax) which again will consequently decrease image quality.

Another problem with blocked developers is that, if the relative discrimination curve (a graph of peak discrimination versus temperature of processing) is too narrow, then the release of the blocked developer in the photographic element as the temperature of the element increases may not be well timed. This may result, for example, in only a small portion of the blocked developer being unblocked as the photographic element is being heated and then, as the element nears the equilibrium temperature, a large amount of blocked developer being unblocked all at once, drowning the coupler with an excess of developing agent, resulting in poor discrimination (high Dmin). It is to be understood that, even though a heater may reach its equilibrium temperature quickly, the photographic element may take some process time to reach its equilibrium or peak temperature, which optionally may be set higher than the temperature of peak discrimination in order to speed the development process.

In general, a broader and flatter relative discrimination curve is desirable. Not only is it more robust relative to variations in process conditions, but it can provide a relatively steady release or unblocking of the developing agent so that the release of the developing agent better matches the reactivity of the developing agent with the coupler and its concentration. This can increase the amount of development occurring at a temperature in the vicinity of peak discrimination for the process. In other words, there is a broader temperature area (element temperature) over which peak discrimination, or near peak discrimination occurs.

Thus, it would be desirable if a higher percentage of peak discrimination for the photothermographic element occurs within over a given temperature range around the peak discrimination temperature, wherein peak discrimination temperature is defined as the temperature at which discrimination peaks when heating the photographic element.

If the relative discrimination curve is narrow, then the photographic element may reach its peak discrimination temperature very quickly without having had time to release the developing agent and then may release the developing agent all at once, which would result, as mentioned above, in the flooding the couplers and poor discrimination. Although one might compensate by heating slower, it is desirable to heat the photographic element quickly to avoid adverse affects of prolonged heating on the photographic element. Thus, it is better to have flatter curve, to provide maximum discrimination for the time period and temperature range of the photothermographic element during the heating process.

In summary of the above, it would be desirable to obtain a photothermographic element, and a method for the thermal development thereof, that is more robust, either by providing a lower processing temperature and/or by providing a flatter relative discrimination curve during thermal processing.

DEFINITION OF TERMS

The term "onset temperature" or $T_o$ is defined as the temperature required to produce a maximum density (Dmax) of 0.5, as described in the Examples below. Lower temperatures indicate more active developers which are desirable.

The term "process temperature" is defined herein as the maximum temperature present in the photographic element during the development process, which may approximate the maximum temperature of the environment with which the photographic element is directly contacted during the development process, which in turn can approximate the temperature of the heating element (source of heat) during the development process in cases of good heat transfer.

The term "discrimination" herein generally means the difference between Dmax and Dmin in an imaging layer.

The term "peak discrimination" or $D_p$ is defined, as in the Examples, for the optimum platen temperature, as corresponding to the value of the difference between Dmax and Dmin (Dmax−Dmin) divided by Dmin.

The term "relative discrimination curve" herein means the discrimination as the temperature of the blocked developer varies.

The term "peak discrimination temperature" herein means the maximum discrimination in the relative discrimination curve.

The term "E" means herein the exposure in lux-seconds.

The term "coupler" indicates a compound that reacts with oxidized color developing agent to create or modify the hue of a dye chromophore.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "dye image-forming coupler" indicates a coupler that reacts with oxidized color developing agent to produce a dye image.

*Research Disclosure* is published by Kenneth Mason Publications, Ltd., Dudley House, 12 North St., Emsworth, Hampshire PO10 7DQ, England.

The term "one-time-use camera" or "OTUC" is used to indicate a camera supplied to the user preloaded with a light sensitive silver halide photographic element and having a lens and shutter. The terms "single-use camera," "film-with-lens unit," "disposable camera" and the like are also employed in the art for cameras that are intended for one use, after which they are recycled, subsequent to removal of the film for development.

SUMMARY OF THE INVENTION

This invention relates to a photothermographic color element containing a mixture of at least two different blocked developers in the same emulsion layer, which blocked developers have different onset temperatures. By different blocked developers is meant two blocked developing agents having (1) the same developing agent upon unblocking, but having different blocking/timing groups, (2) the same blocking and/or timing groups but different developing agents when unblocked, and/or (3) both different developing agents upon complete unblocking and different blocking and/or timing groups.

The term blocking/timing group is meant the portion of the blocked developer other than the developing agent that reacts with a coupler. The blocking/timing group, therefore, separates from the developing agent, even if in stages, over time.

In one embodiment of the invention, mixtures of blocked developers have been found that provide lower processing temperatures and/or shorter times of development compared to the blocked developer alone having the higher onset temperature, and at the same time, improved discrimination compared to the blocked developer alone having the lower onset temperature. In some cases, higher peak discrimination than obtainable with either of the blocked developers alone at the given process temperature is obtainable.

In another embodiment of the invention, mixtures of blocked developers have been found that provide a lower slope f the relative discrimination versus temperature curve, thereby providing a flatter and more robust relative discrimination curve compared to either blocked developer alone.

Preferably, when the developer mixture is used in a dry physical development system, the developer is thermally activated at temperatures between about 80 and 180° C., preferably 100 to 170° C. When the developer is used in an apparently dry chemical development system, however, the developer mixture is preferably thermally activated at temperatures between about 60 and 120° C., preferable 65 to 100° C., in the presence of added acid, base or water.

In particular, the present invention is directed to a color photothermographic color element comprising at least three light-sensitive units that have their individual sensitivities in different wavelength regions comprising a silver halide imaging layer having associated therewith a mixture of at least two locked developing agents comprising a Blocked Developer A and blocked Developer B independently represented by Structure I:

$$\text{DEV-(LINK, 1)}_l\text{-(TIME)}_m\text{-(LINK2)}_n\text{-M} \qquad \text{I}$$

wherein,

DEV is a silver-halide color developing agent;

LINK 1 and LINK 2 are linking groups;

TIME is a timing group;

l is 0 or 1;

m is 0, 1, or2;

n is 0 or 1;

l+n is 1 or 2;

M is a blocking group or M is:

$$\text{-M'-(LINK 2)}_n\text{-(TIME)}_m\text{-(LINK 1)}_l\text{-DEV}$$

wherein M' is a blocking group that also contains another blocked developer, which may be the same or a different developing agents; and wherein the onset temperature of Blocked Developer A is less than the onset temperature of Blocked Developer B, the onset temperature of Blocked Developer A is in the range of 110° C. to 160°C., preferably 110 to 150° C., and the onset temperature of Blocked Developer B is in the range of 130 to 170° C., preferably 140 to 160° C., and the difference in the onset temperatures of the two Blocked Developers is 5 to 50° C., preferably 8 to 40° C., more preferably 10 to 30° C.

In a preferred embodiment of the invention, the peak discrimination of the mixture of Blocked Developer A and Blocked Developer B will be higher than the discrimination of Blocked Developer B. In a particularly preferred embodiment, the peak discrimination of the mixture is higher than the peak discrimination of both Blocked Developer A and Blocked Developer B.

The invention additionally relates to a method of image formation having the steps of: thermally developing an imagewise exposed photographic element having a mixture of blocked developers as described above that decomposes to release corresponding developing agents on thermal activation to form a developed image. Preferably, following development, the developed image is then scanned to form a first electronic-image representation (or "electronic record") from said developed image, the first electronic record is digitized to form a digital image, and the digital image is modified to form a second electronic-image representation, which can be stored, transmitted, printed or displayed.

The invention further relates to a one-time use camera having a light sensitive photographic element comprising a support and a mixture of blocked developers as described above that releases a mixture of developing agents or differentially releases the same developing agents (in the same or different imaging layers) on thermal activation. The invention further relates to a method of image formation having the steps of imagewise exposing such a light sensitive photographic element on thermal activation in a one-time-use camera having a heater and thermally processing the exposed element in the camera.

In a preferred embodiment of the invention, LINK 1 and LINK 2 are of structure II:

II

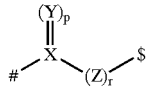

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1; with the proviso that when X is carbon, both p and r are 1, when X is sulfur, Y is oxygen, p is 2and r is 0;

# denotes the bond to PUG (for LINK 1) or TIME (for LINK 2):

$ denotes the bond to TIME (for LINK 1) or $T_{(t)}$ substituted carbon (for LINK 2).

DETAILED DESCRIPTION OF THE INVENTION

Figure 1:
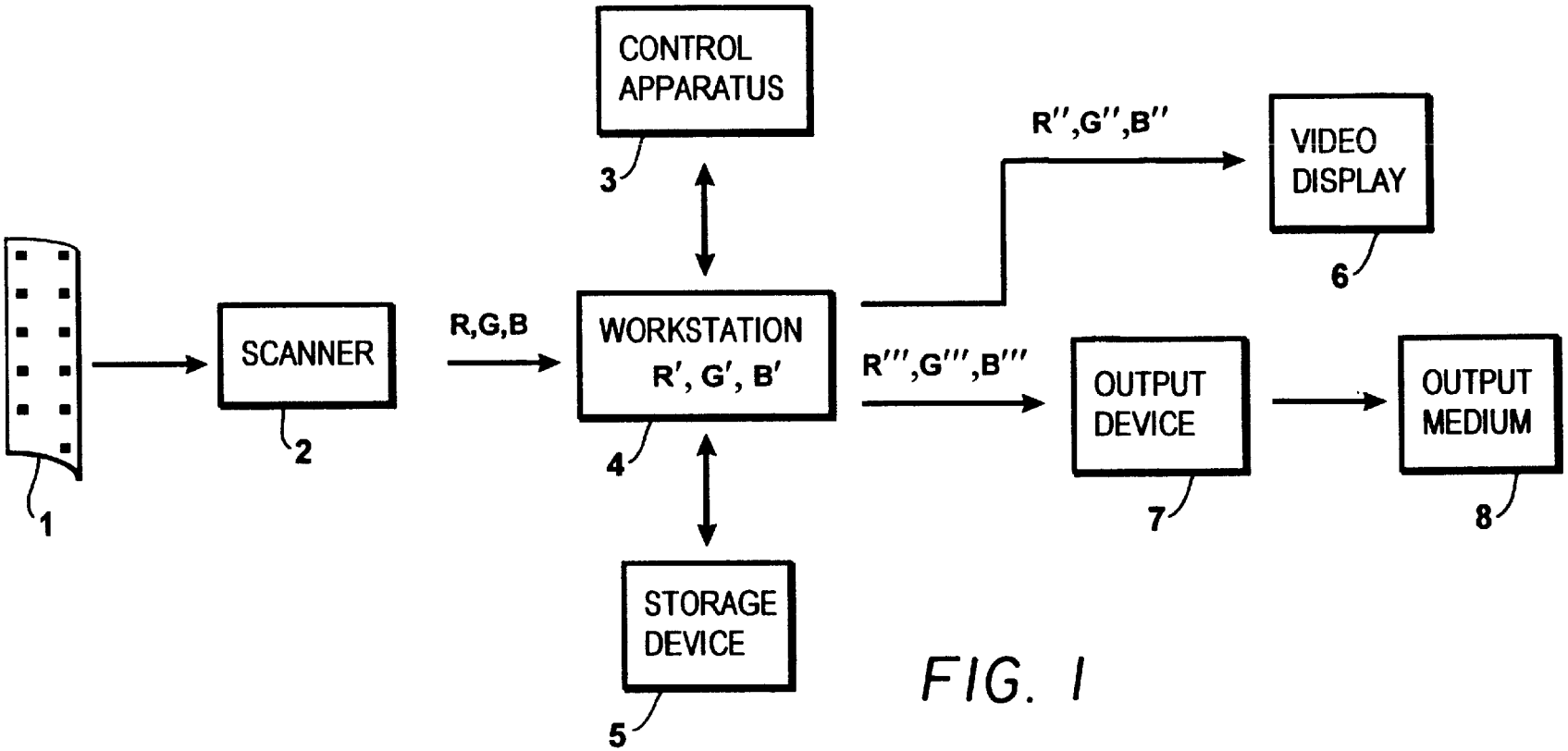
FIG. 1 shows in block diagram form an apparatus for processing and viewing image formation obtained by scanning the elements of the invention.

In Structure I above, the developing agents are silver halide, dye-forming developing agents. The developing agent can be present in the blocked compound as a preformed species or as a precursor. They include aminophenols, phenylenediamines, hydroquinones, pyrazolidinones, and hydrazines. Illustrative developing agents are described in U.S. Pat. Nos. 2,193,015, 2,108,243, 2,592,364, 3,656,950, 3,658,525, 2,751,297, 2,289,367, 2,772,282, 2,743,279, 2,753,256, and 2,304,953, the entire disclosures of which are incorporated herein by reference.

Illustrative developers are as follows:

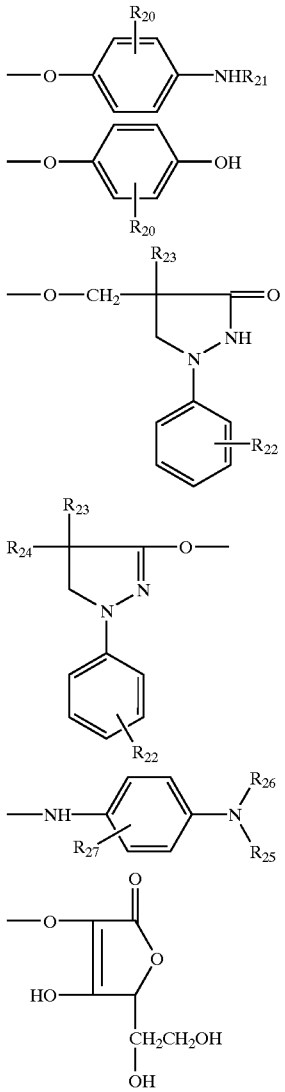

wherein $R_{20}$ is hydrogen, halogen, alkyl or alkoxy;

$R_{21}$, is a hydrogen or alkyl;

$R_{22}$ is hydrogen, alkyl, alkoxy or alkenedioxy; and $R_{23}$, $R_{24}$, $R_{25}R_{26}$ and $R_{27}$ are hydrogen alkyl, hydroxyalkyl or sulfoalkyl.

As mentioned above, in a preferred embodiment of the invention, LINK 1 or LINK 2 are of structure II:

II

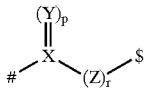

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

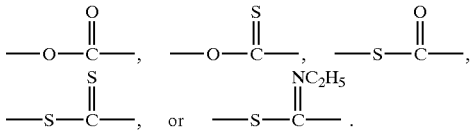

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. No. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

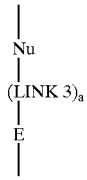

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

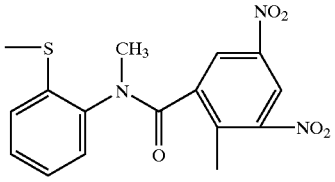

and

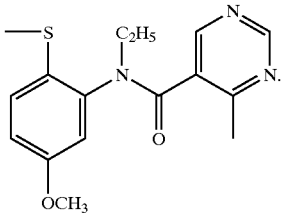

These timing groups are described more fully in U.S. Pat. No. 5,262,291, incorporated herein by reference.

T-2

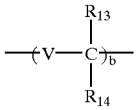

wherein

V represents an oxygen atom, a sulfur atom, or an

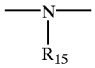

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

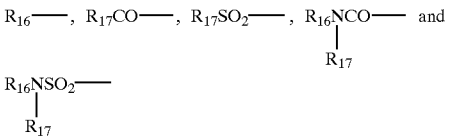

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

T-3

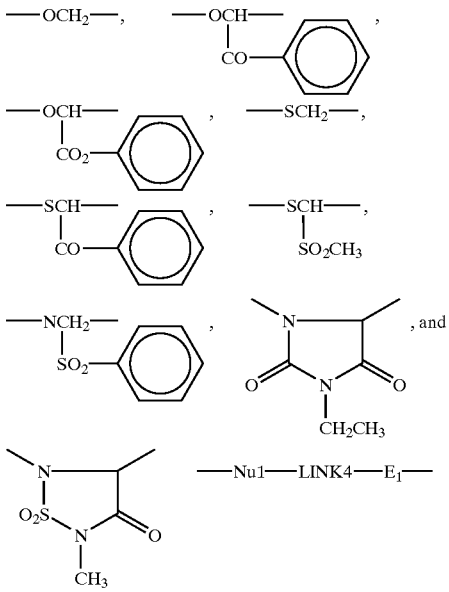

wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

T-4

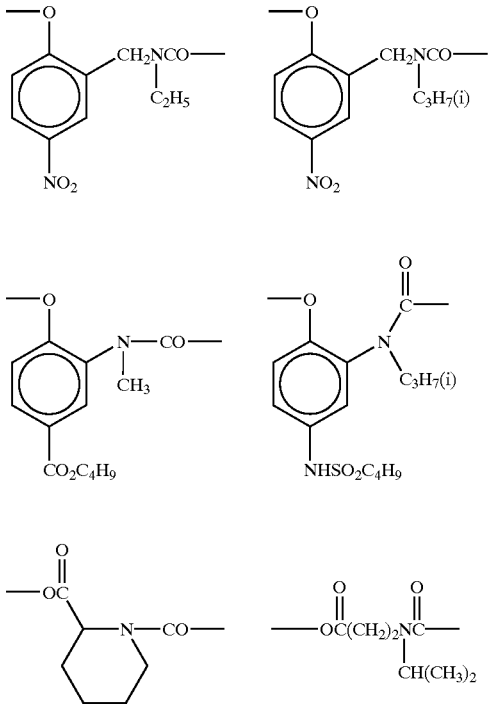

-continued

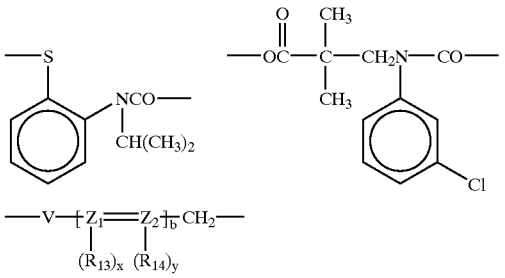

wherein V, $R_{13}$, $R_4$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

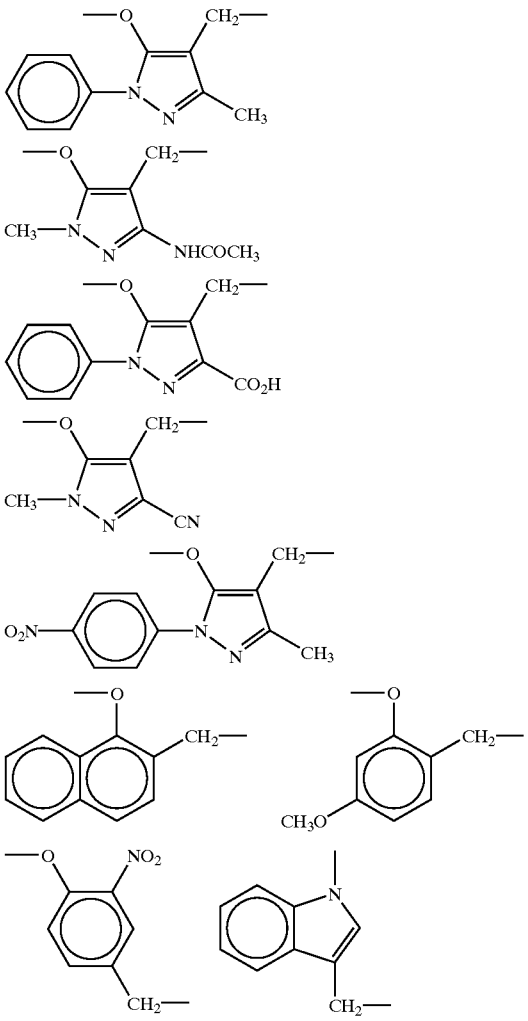

-continued

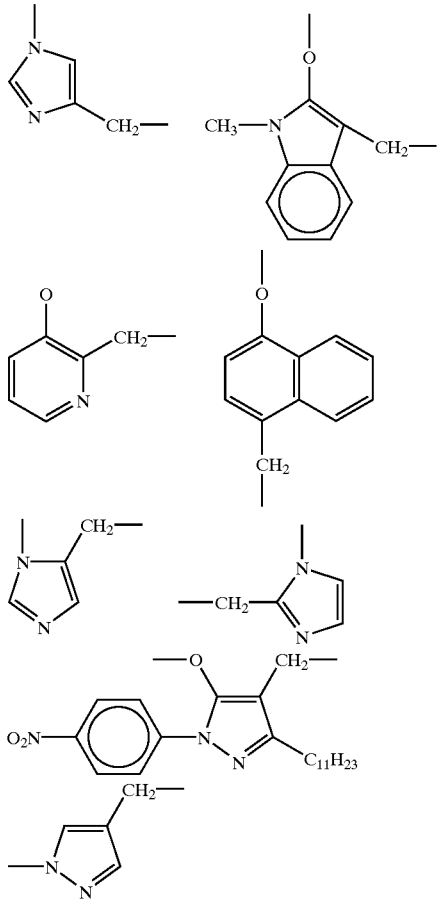

In one embodiment of the invention, the mixture of blocked developers comprises a first blocked developer (Blocked Developer A) having a relatively lower onset temperature, and a second blocked developer (Blocked Developer B) having a relatively higher onset temperature. Suitably, the onset temperature of Developer A is in the range of 110 to 160 C., preferably 110 to 150 and the onset temperature of Blocked Developer B is in the range 130 to 170 C., and the difference in the onset temperatures of the two developing agents are 5 to 50 C., preferably 8 to 40, more preferably 10 to 30 C.

Suitably, the ratio or relative amounts of the at least two developing agent can be adjusted to obtain the desired property of the mixture. Suitably, Blocked Developer A is present in the amount of 5 to 95 mol percent, preferably 20 to 80, and Developing Agent B is present in the amount of 95 to 5 mol percent, preferably 80 to 20 percent . There may be more than two developing agents in a mixture. However, where a third developing agent or a third and fourth developing agent is present, the additional developing agents are preferably in an amount less than 30 percent, more preferably less than 20 percent, most preferably less than 10 percent.

As indicated above, the mixture of blocked developing agents can also be selected to increase the peak discrimination relative to one or both of the blocked developers. This is usually desirable because it provides a higher quality image. The mixture of blocked developing agents can also be adjusted so that the relative discrimination curve is flatter than that of either blocked developer alone. This is usually desirable, so that the heating process is more robust. In this case, the overall discrimination, with respect to the overall temperature range of development, is higher than either individual blocked developing agent alone.

As indicated above, the photothermographic color element comprises at least three light-sensitive units that have their individual sensitivities in different wavelength regions comprising a silver halide imaging layer having associated therewith a mixture of at least two blocked developing agents comprising Blocked Developer A and a Blocked Developer B independently having Structure I:

$$\text{DEV-(LINK 1)}_l\text{-(TIME)}_m\text{-(LINK 2)}_n\text{-M} \qquad \text{Structure I}$$

wherein,

DEV is a silver halide color developing agent;

LINK 1 and LINK 2 are linking groups;

TIME is a timing group;

l is 0 or 1;

m is 0, 1, or 2;

n is 0 or 1;

l+n is 1 or 2;

M is a blocking group or M is:

$$\text{-M'-(LINK 2)}_n\text{-(TIME)}_m\text{-(LINK 1)}_l\text{-DEV}$$

wherein M' is also a blocking group for a second developing agent.

In a preferred embodiment of the invention, at least one of the blocked developing agents have the Structure II:

II

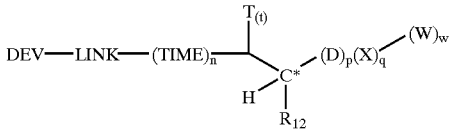

wherein:

DEV is a developing agent;

LINK is a linking group as defined above;

TIME is a timing group as defined above;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN, a halogenated alkyl group, for example —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any hydrogenated carbons except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(R_{15})N(R_{16})$—, and the like, in which the atoms in the backbone of the X group (in a direct line between the C* and W) a re not attached to any hydrogen atoms.

W is W' or a group represented by the following Structure IIA:

IIA

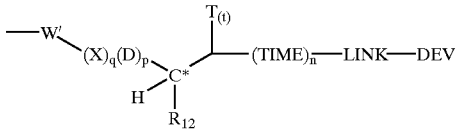

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IA, W' comprises a least one substituent, namely the moiety to the right of the W' group in Structure IA, which substituent is by definition activating, comprising either X or D);

W is an activating group when W has structure IA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, —CN, or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$,etc.

$R_{13}$ , $R_{14}$, $R_{15}$ , and $R_{16}$ can independently be selected from substituted or unsubstituted alkyl, aryl, or heterocyclic group, preferably having 1 to 6 carbon atoms, more preferably a phenyl or C1 to C6 alkyl group.

Any two members of the set $R_{12}$, T, and either D or W, that are not directly linked, may be joined to form a ring, provided that creation of the ring will not interfere with the functioning of the blocking group.

More preferably, the blocked developers used in the present invention is within Structure I above, but represented by the following narrower Structure IIB:

Structure IIB

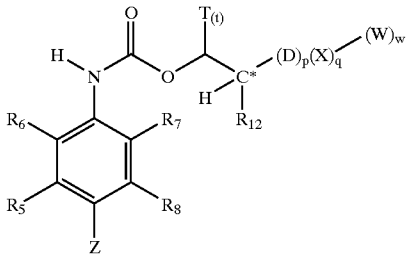

It will be noticed that the M group in Structure I, according to Structure II has the following structure:

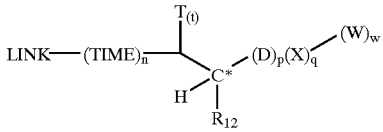

This class of blocked developing agents is believed to involve an unblocking reaction that is a 1, 2 elimination with respect to the bond between the carbons alpha and beta to the adjacent linking groups.

In another embodiment of the invention, both Blocked Developers A and B fall within the scope of Structure II or IIB.

The following are representative examples of blocked developer compounds of Structure II for use in the invention:

D-1

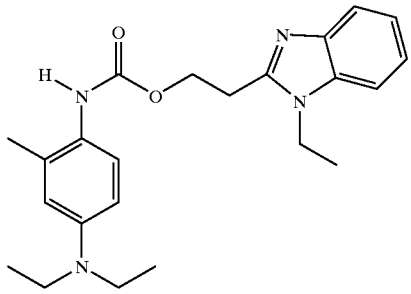

D-2

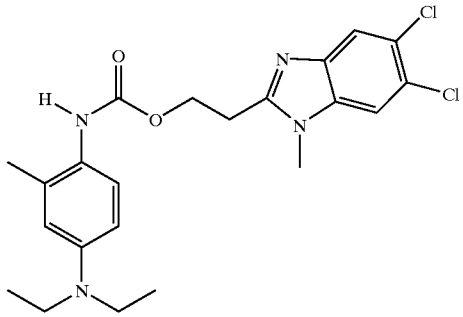

-continued

D-3

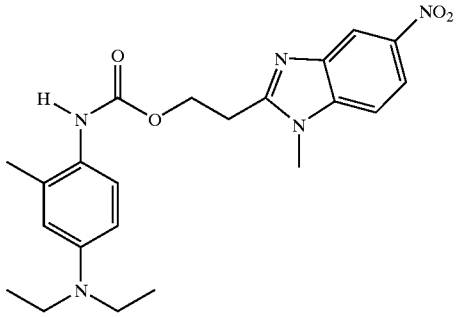

D-4

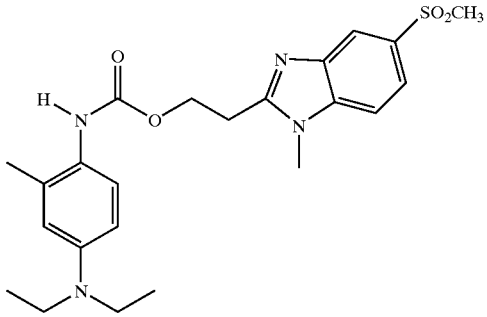

D-5

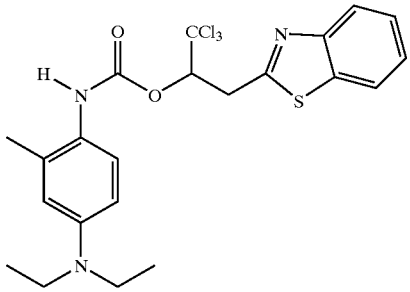

D-6

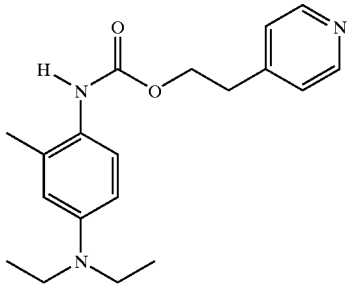

D-7

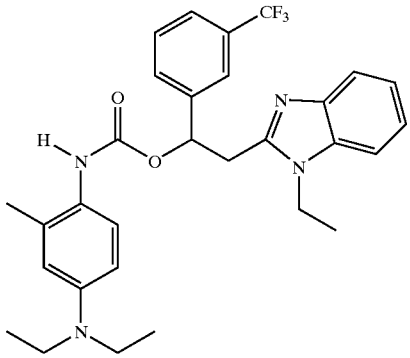

-continued
D-8
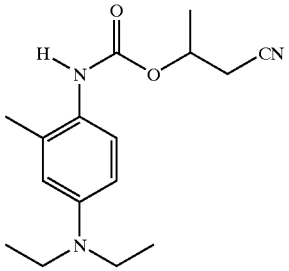
D-9
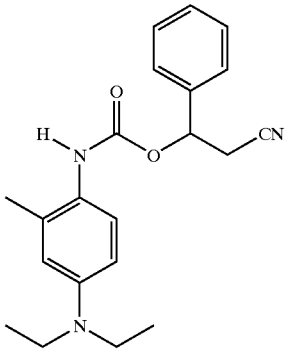
D-10
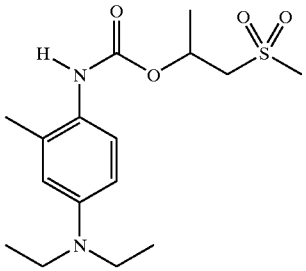
D-11
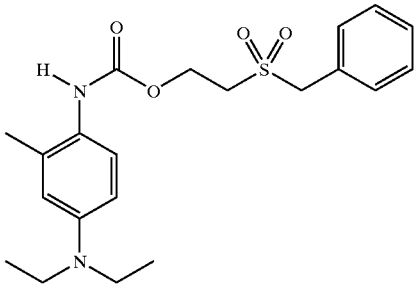
D-12
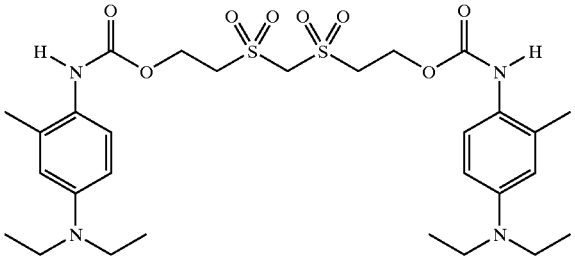
-continued
D-13
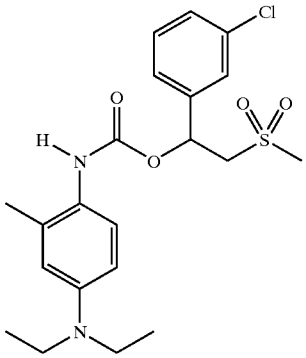
D-14
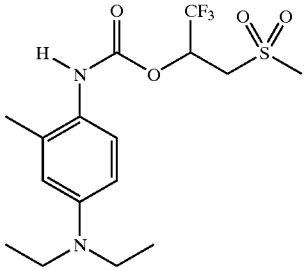
D-15
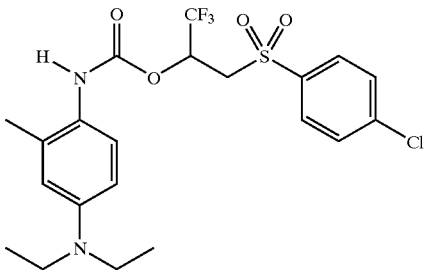
D-16
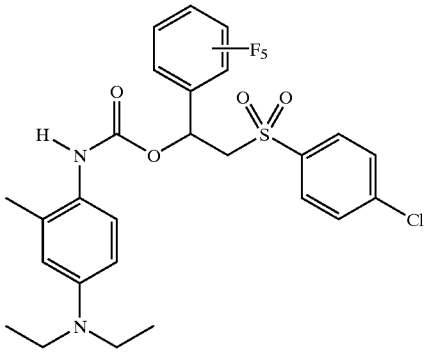

-continued
D-17
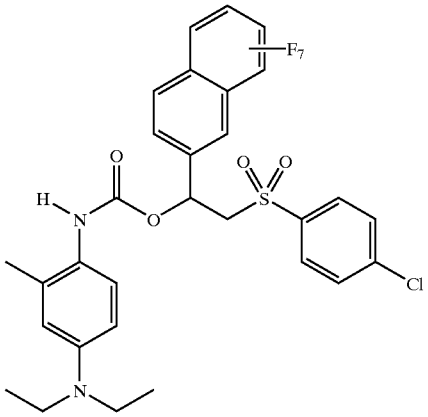
D-18
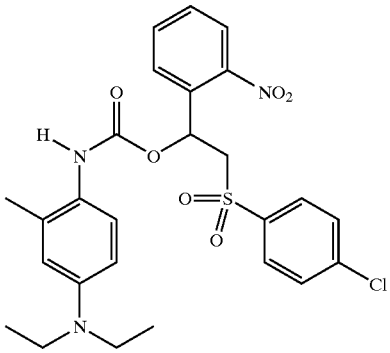
D-19
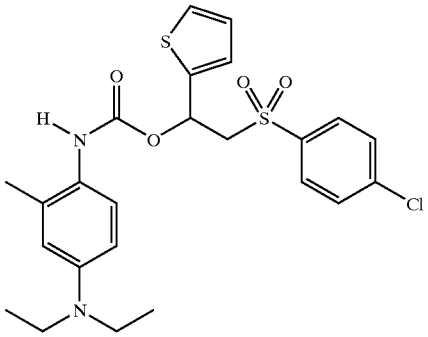
D-20
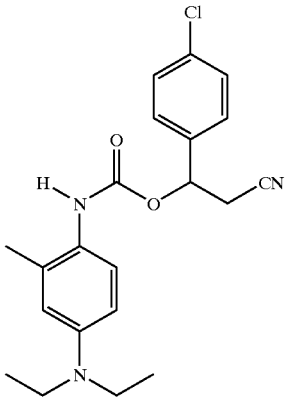
-continued
D-21
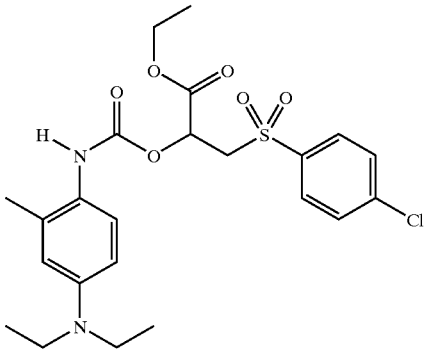
D-22
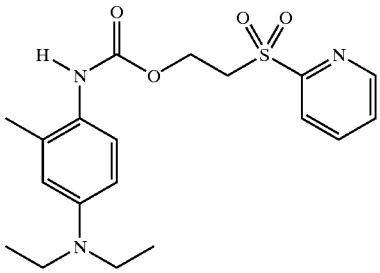
D-23
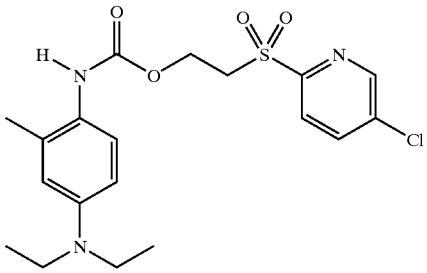
D-24
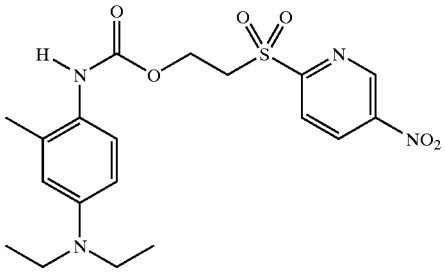
D-25
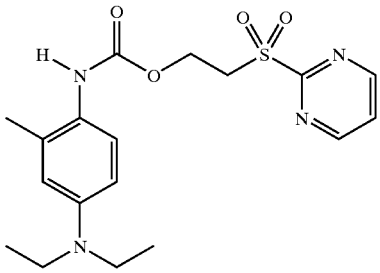

-continued
D-26
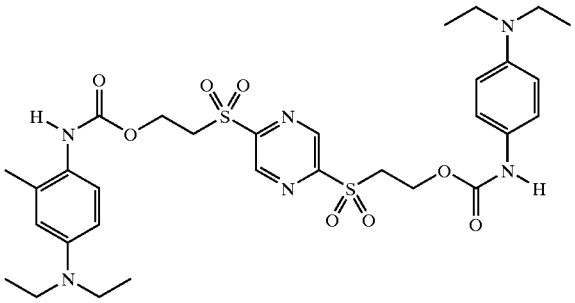
D-27
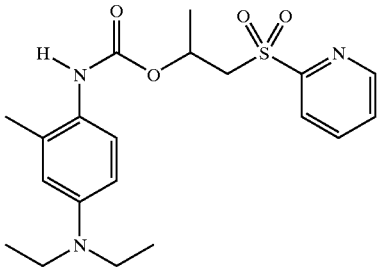
D-28
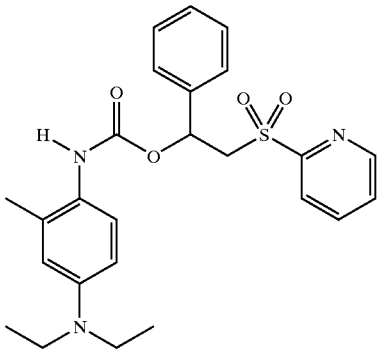
D-29
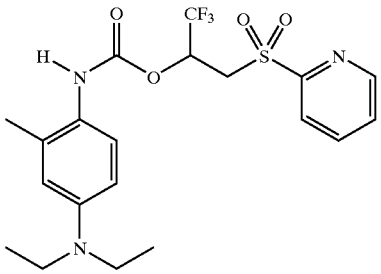
D-30
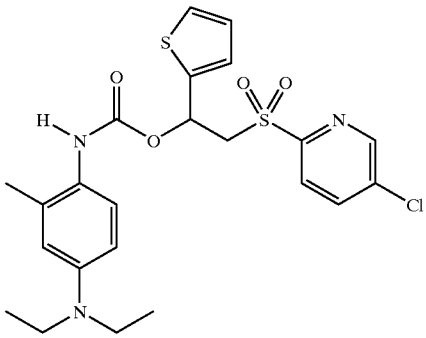
-continued
D-31
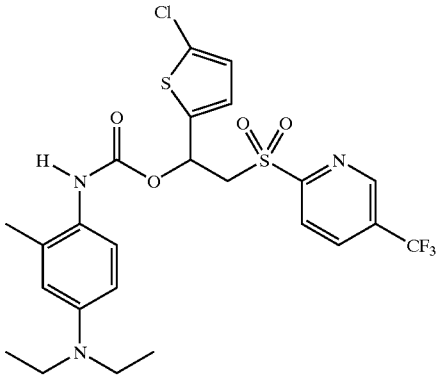
D-32
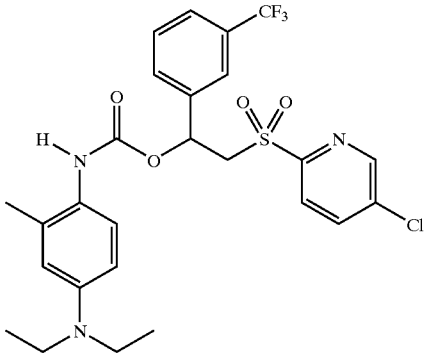
D-33
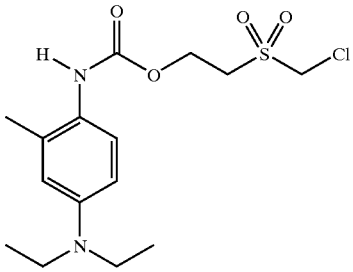
D-34
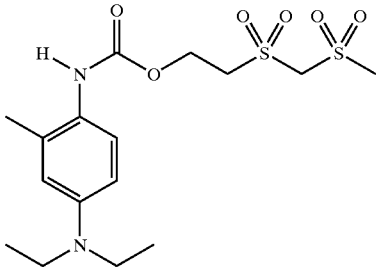
D-35
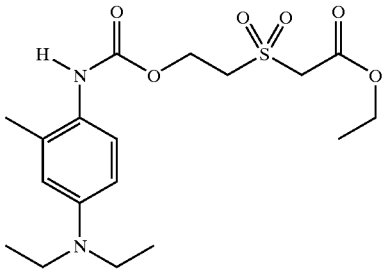

-continued
D-36
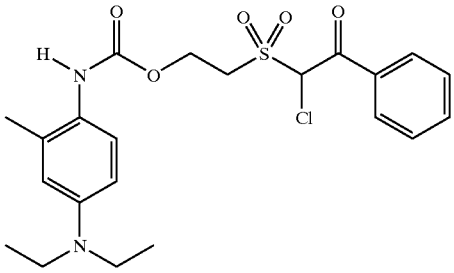
D-37
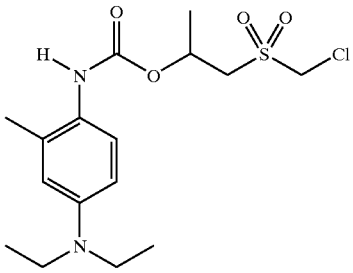
D-38
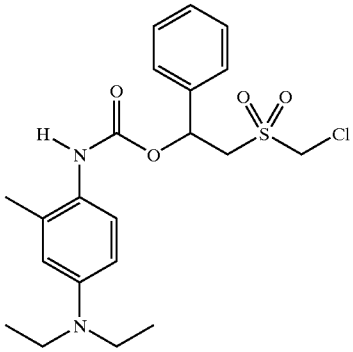
D-39
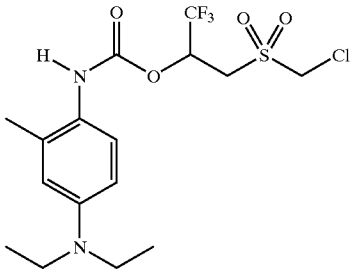
D-40
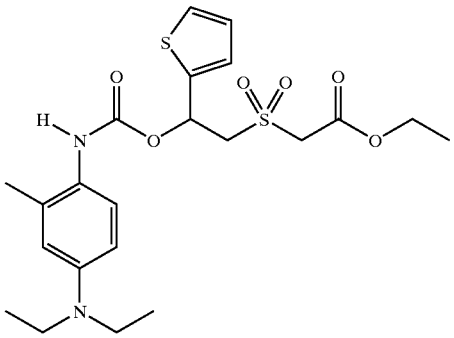
-continued
D-41
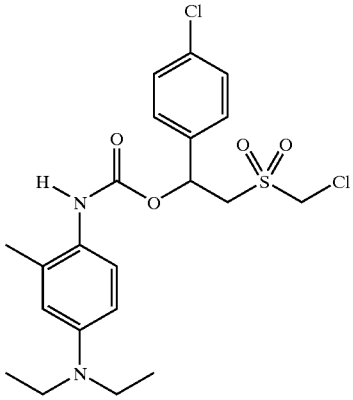
D-42
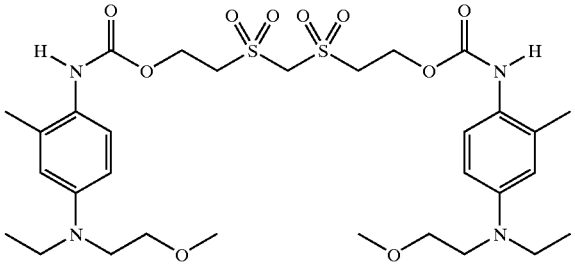
D-43
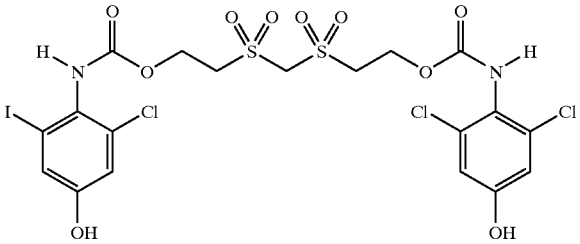
D-44
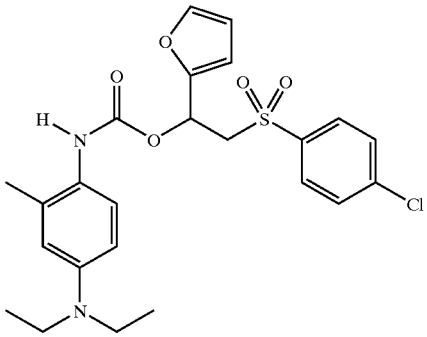
D-45
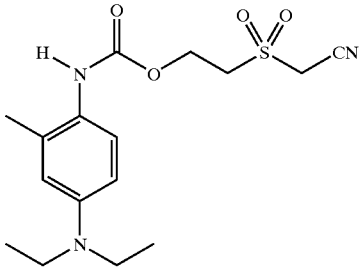

In another preferred embodiment of the present invention, either blocked developer A or blocked developer B may have the general structure shown in Structure III:

III

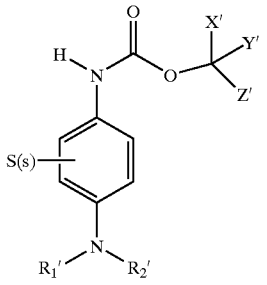

where:

$R_1'$ and $R_2'$ are independently hydrogen or an alkyl group, which may be further substituted, or $R_1'$ and $R_2'$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further substituted or S substituents that are ortho to the $NR_1'R_2'$ substituent can form a heterocyclic ring with $P_1$ or $P_2$; and s is 0 to 4;

X', Y', and Z' represent substituents selected independently from the groups hydrogen, alkyl group of 1 to 6 carbon atoms, cyclopropyl, aryl, arylalkyl, and heterocyclic groups. The cyclopropyl group may be further substituted with an alkyl group of 1 to 6 carbon atoms. The aryl and heterocyclic groups may be in turn substituted with the following substituents: halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

In a preferred embodiment, when cyclopropyl, aryl or heterocyclic groups are not chosen as X', Y' or Z', then all three groups must be selected from among alkyl or arylalkyl groups. Additionally, two members of the X', Y', and Z' set can join to form a ring. Typically, the aryl group is represented by phenyl, 1-naphthyl, 2-naphthyl, and 9-anthracyl groups while the heterocyclic group is best represented by 2-furyl, 3-furyl, 2-thienyl, 3-thienyl, 2-pyrrolyl, 3-pyrrolyl, 2-thiazolyl, 2-benzothienyl, 3-benzothienyl, 2-indolyl, and 3-indolyl.

The following are representative examples of blocked developer compounds of Structure III for use in the invention:

D-46

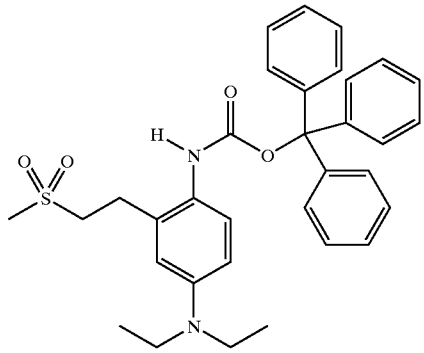

D-47

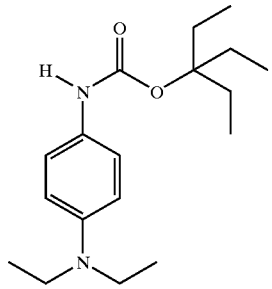

D-48

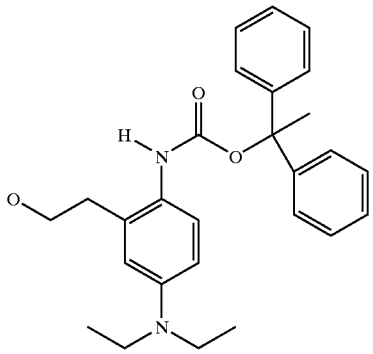

D-49

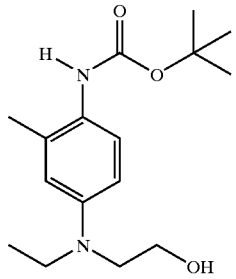

D-50

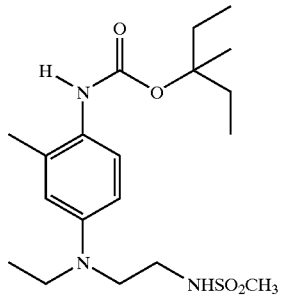

-continued
D-51
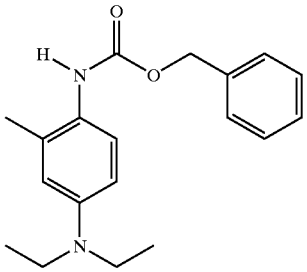
D-52
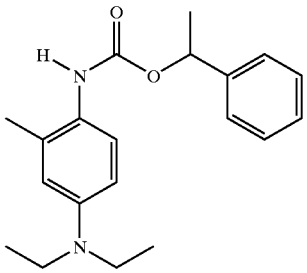
D-53
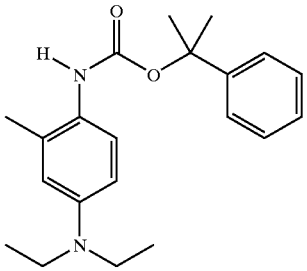
D-54
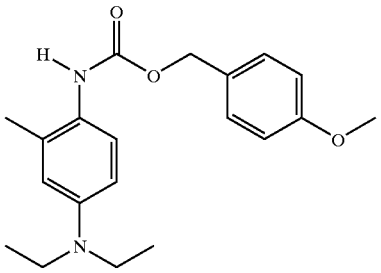
D-55
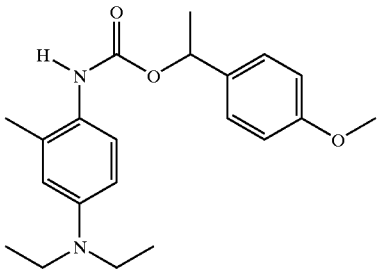
-continued
D-56
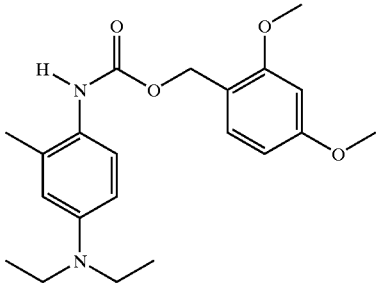
D-57
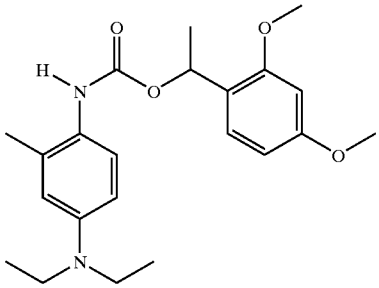
D-58
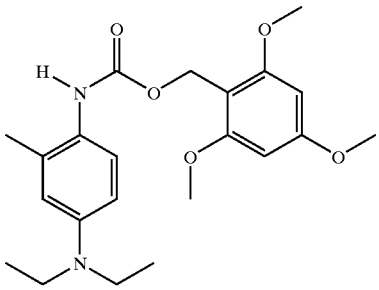
D-59
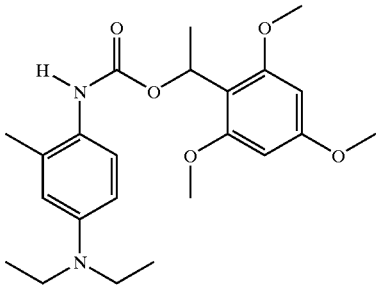
D-60
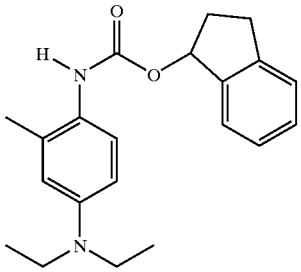

-continued
D-61
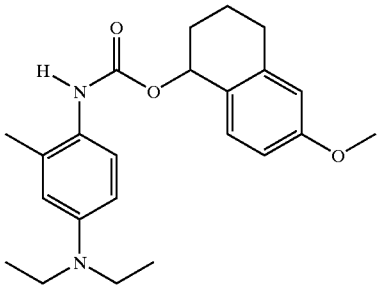
D-62
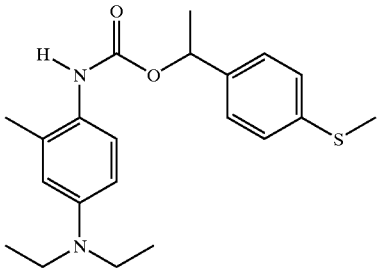
D-63
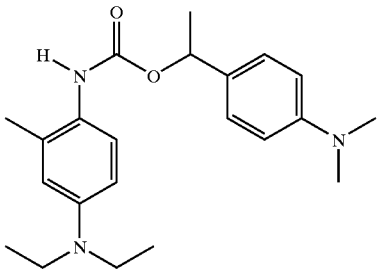
D-64
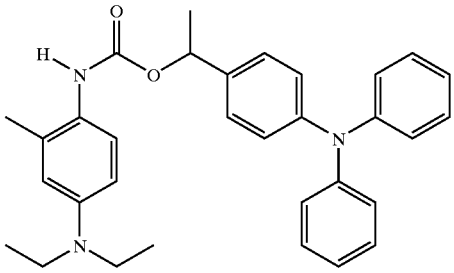
D-65
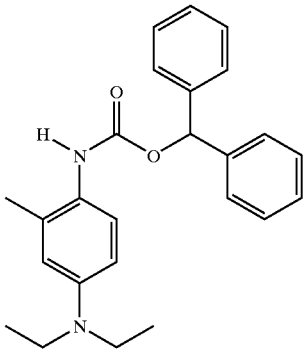
-continued
D-66
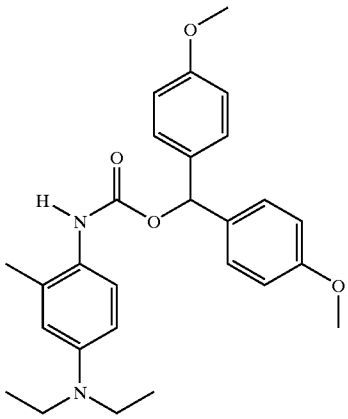
D-67
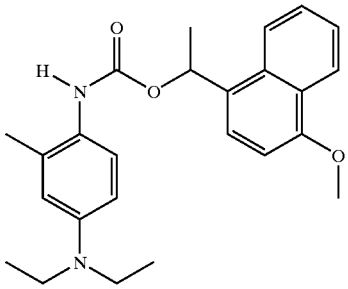
D-68
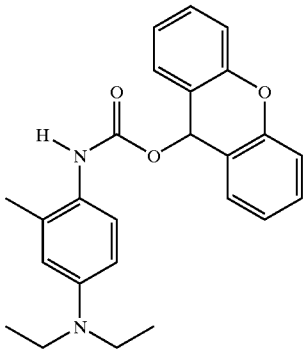
D-69
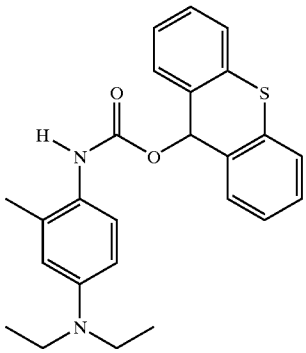

-continued
D-70
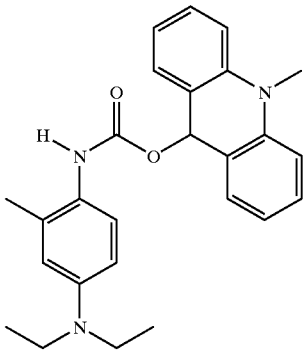
D-71
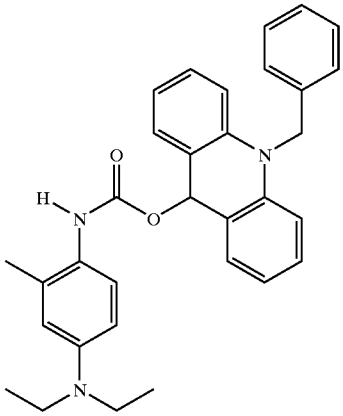
D-72
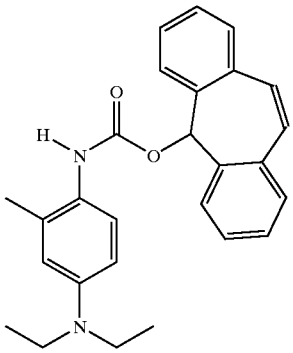
D-73
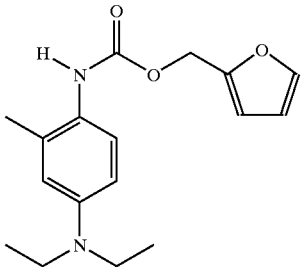
-continued
D-74
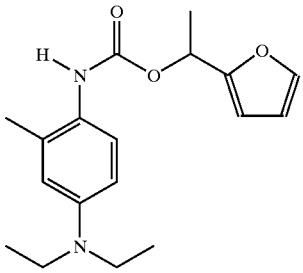
D-75
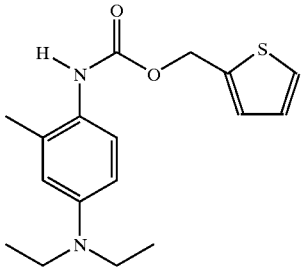
D-76
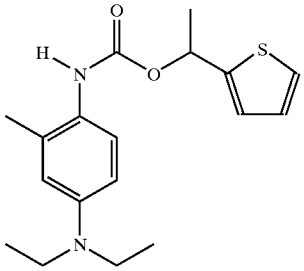
D-77
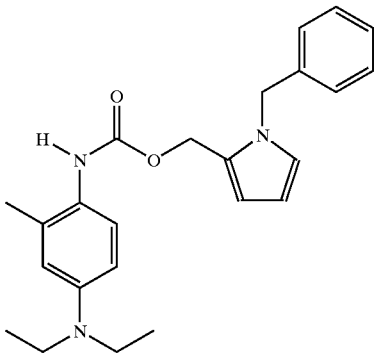
D-78
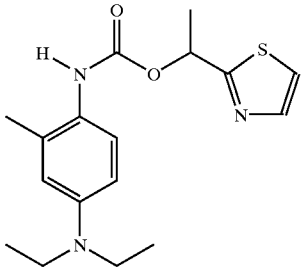

-continued
D-79
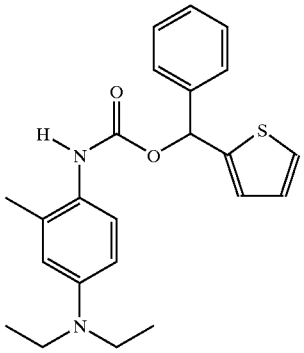
D-80
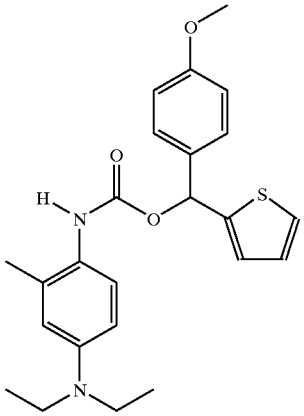
D-81
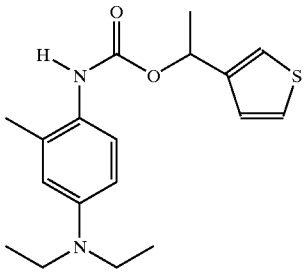
D-82
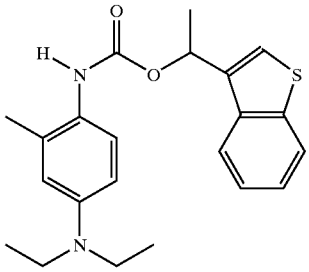
D-83
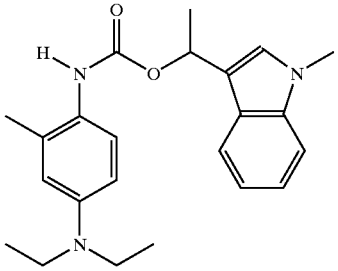
-continued
D-84
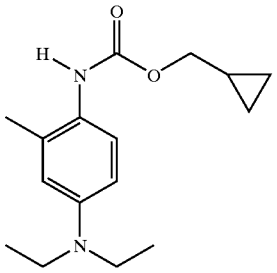
D-85
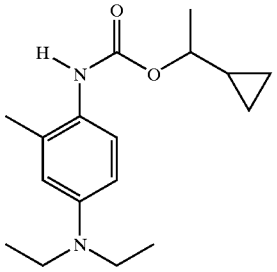
D-86
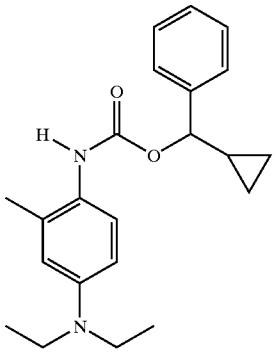
D-87
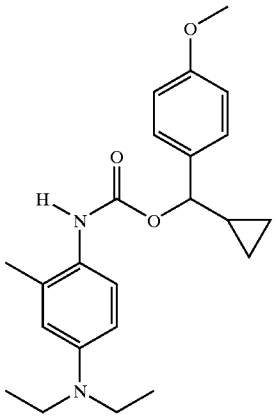
D-88
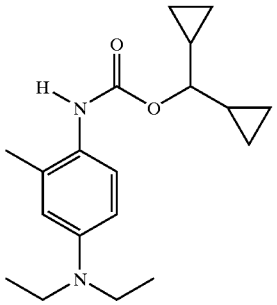

-continued
D-89
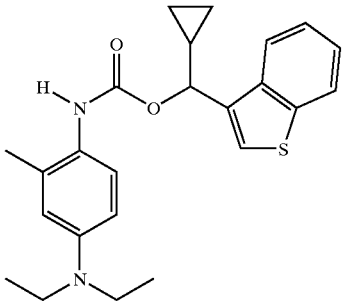
D-90
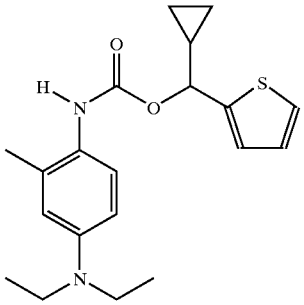
D-91
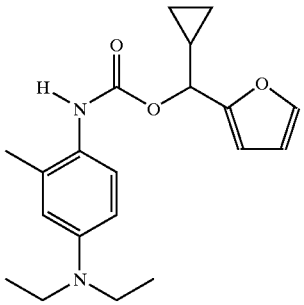
D-92
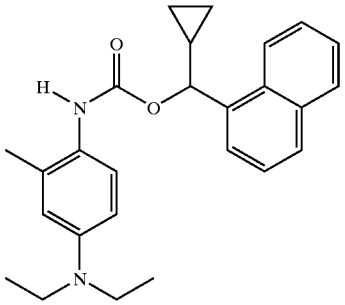
D-93
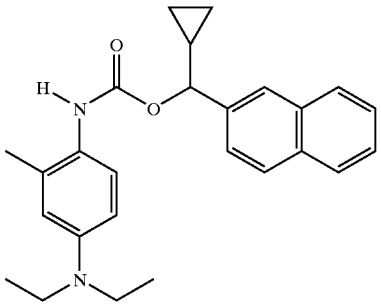
-continued
D-94
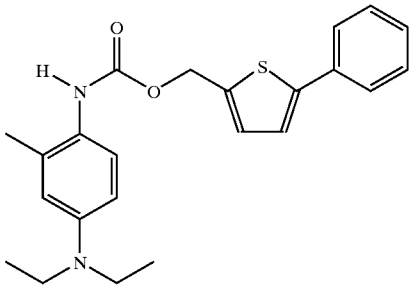
D-95
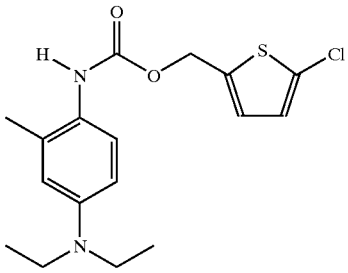
D-96
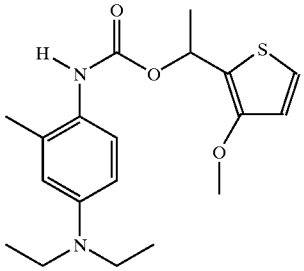
D-97
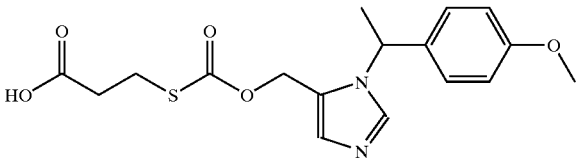
D-98
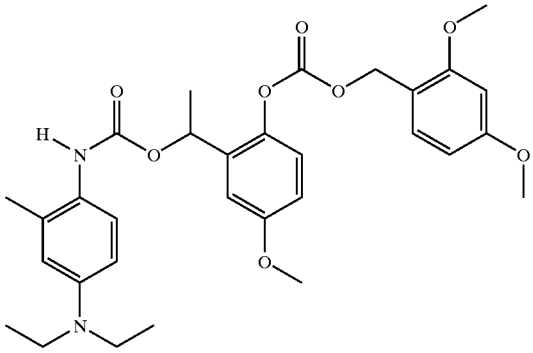

-continued

D-99

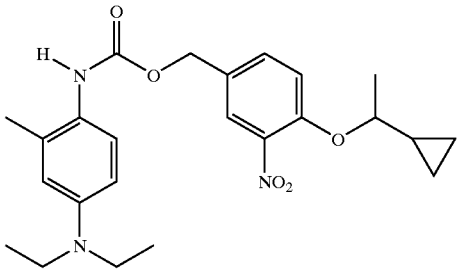

D-100

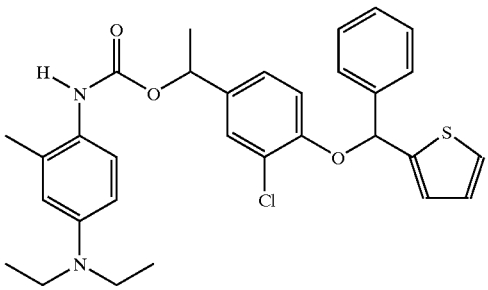

D-101

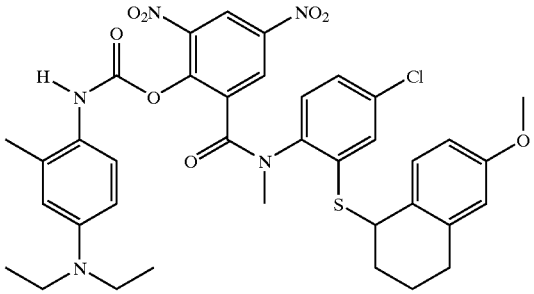

D-102

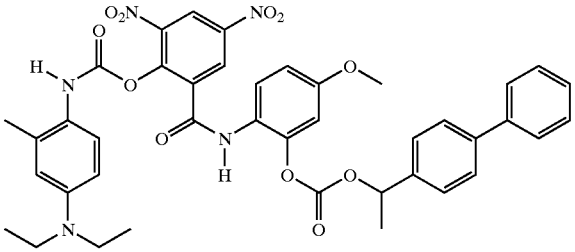

D-103

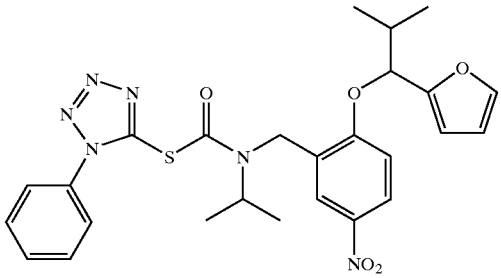

In yet another embodiment of the present invention, either blocked developer A or B has a blocking group comprising a disubstituted nitrogen (NIT), for example a substituted or unsubstituted benzimidazolyl, benzothiazolyl, benzoxazolyl, benzothiophenyl,benzofuryl, furyl, imidazolyl, indazolyl, indolyl, isoquinolyl, isothiazolyl, isoxazolyl,, oxazolyl, picolinyl, purinyl,, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, triazolyl, diphenylamino and carbazolyl group. Particularly preferred are: 1-imidazolyl, 1-benzimidazolyl, 1-pyrrolyl, 1-indolyl, 1-carbazolyl, 1-pyrazolyl, 1-indazolyl, N,N-diarylamino, and 1-tetrahydrocarbazolyl . The heterocyclic group may be further substituted. Preferred substituents are alkyl and alkoxy groups containing 1 to 6 carbon atoms.

In one preferred embodiment of the invention, the photographic element comprising an imaging layer having in association therewith a blocked developer of Structure IV:

IV

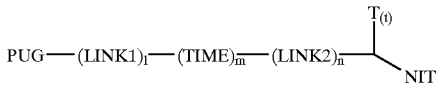

wherein

PUG is a photographically useful group;

LINK 1 and LINK 2 are first and second linking groups adjacent, respectively the timing group and the blocking group;

TIME is a timing group;

T represents t independently selected substituted or unsubstituted alkyl (preferably containing 1 to 6 carbon atoms) or aryl groups (preferably phenyl or naphthyl), t is 0, 1, or 2 and if t is 2, the T groups can form a ring;

NIT is a disubstituted nitrogen group which optionally can form a ring system with a T group;

l is 0 or 1;

m is 0, 1, or 2; and n is 0 or 1.

It will be observed that the Blocked Developer of Structure V is according to Structure I with the M group having the following Structure IVA:

IVA

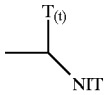

wherein

T represents t independently selected substituted or unsubstituted alkyl or aryl groups, t is 0, 1, or 2 and if t is 2, the T groups can form a ring; and NIT is a disubstituted nitrogen group which optionally can form a ring.

Particularly preferred photographically useful compounds of the class of blocked developing agents according to Structure IV have the following Structure IVB:

IVB

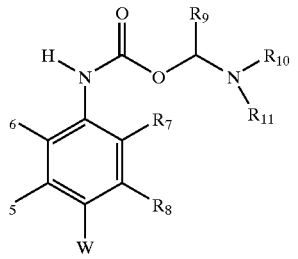

wherein:

W is OH or $NR_2R_3$, and $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or R6 and/or $R_8$ can connect to $R_2$ or $R_7$ to form a ring;

T is hydrogen, alkyl, aryl, heteroaromatic or alkoxy groups, —$NO_2$, —CN, an electron withdrawing group substituted by $R_{13}$ (—$SO_2R_{13}$, —$OSO_2R_{13}$, —$N(SO_2)R_{13}$, —$CO_2R_{13}$, —$CCl_2R_{13}$, —N(C═O)$R_{13}$, etc; or when T is a divalent group it can combine with $R_{10}$or $R_{11}$ to form a ring. Preferably, T is an electron withdrawing group, including alkyl groups or aryl groups substituted with one to seven electron withdrawing groups.

$R_{10}$ and $R_{11}$ are independently alkyl, aryl, substituted aryl or heteroaromatic substituents which can be connected to form a ring system with the nitrogen atom that is a heteroaromatic or saturated or unsaturated heterocyclic ring and which may optionally contain additional heteroatoms.

The following are representative examples of blocked developer compounds of Structure IVB:

D-103

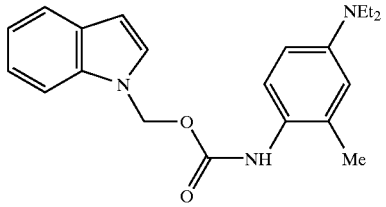

D-104

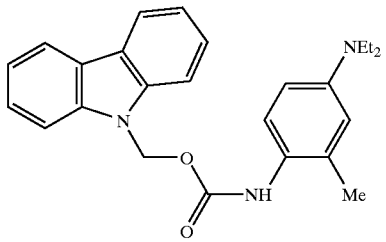

-continued

D-105

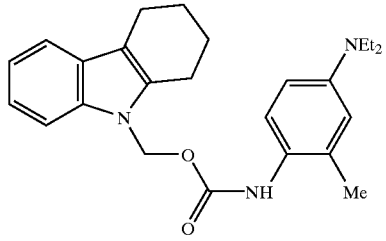

D-106

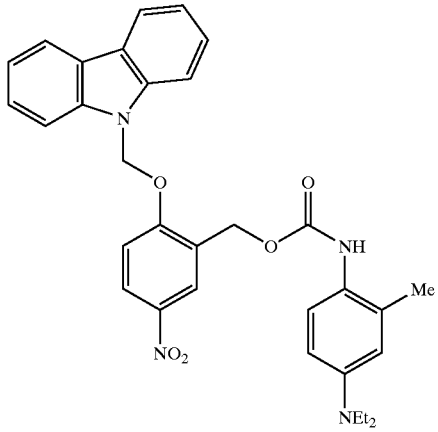

D-107

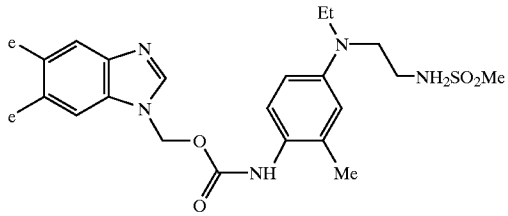

D-108

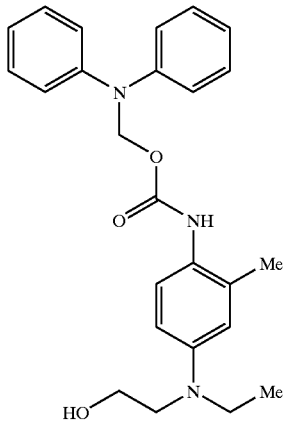

D-109

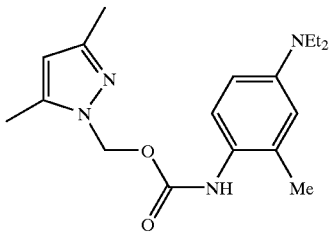

-continued

D-110

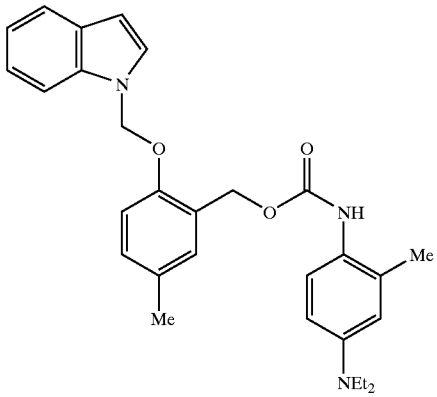

D-111

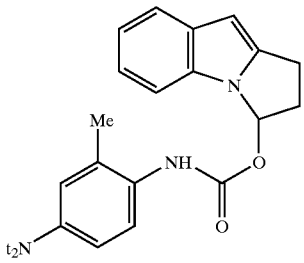

D-112

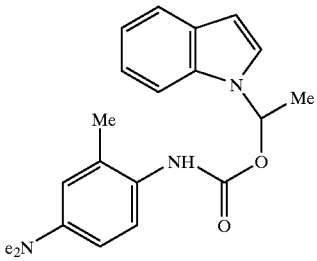

D-113

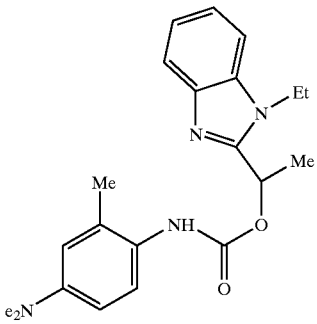

D-114

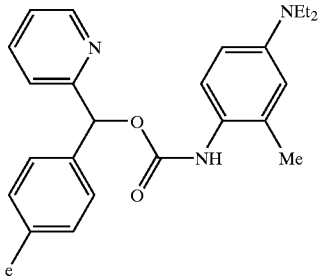

-continued

D-115

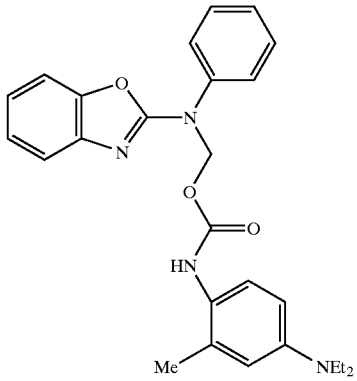

In another embodiment of the present invention, both blocked developers A and B have Structure II or IIB above. In yet another embodiment of the invention, only one of the blocked developer have Structure II and another blocked developer has Structure III, IV or IVB.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems, "heteroaromatic group" refers to a substituted or unsubstituted heteroaromatic (with up to five substituents), and heterocyclic group refers to a substituted or unsubstituted heterocyclic (with up to five substitutuents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group or, it will be understood that these can be branched, unbranched or cyclic.

The mixture of blocked developer is preferably incorporated in one or more of the imaging layers of the imaging element. Preferably, the same mixture is used in all the imaging layers, in the same or different proportions. Alternatively, a mixture may only be present in one or some, but not all, of the imaging layers, different mixtures of blocked developers may be used in different imaging layers. See commonly assigned U.S. Ser. No 60/211,452, hereby incorporated by reference in its entirety.

The amount of each blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developer can be contained in a separate element that is contacted to the photographic element during processing.

As indicated above, the onset temperature of Developing Agent A is less than the onset temperature of Developing Agent B, the onset temperature of Developing Agent A is in the range of 110 to 160 C., preferably 110 to 150 and the onset temperature of Developing Agent B is 130 to 170 C. and the difference in the onset temperatures of the two developing agents are 5 to 50 C, preferably 8 to 40, more preferably 10 to 30 C. In one embodiment of the invention, at least two developing agents comprise at least two developing agents of Structure II, preferably Structure IIB. In another embodiment of the invention, at least two developing agents comprise at least one developing agent of Structure II, preferably Structure IIB and at least one developing agent of Structure III. In another embodiment of the invention at least two developing agents comprise at least one developing agent of Structure II, preferably Structure IIB, and at least one developing agent of Structure IV, preferably Structure IVB, wherein the developing agent of Structure IV or IVB has a relatively lower onset temperature.

After image-wise exposure of the imaging element, the mixture of blocked developers is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

The blocked developer is preferably incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

The blocked compounds may be used in any form of photographic system. A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure I*.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945, and 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure* I , cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I , cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I , Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I , cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I , X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density-i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure* I, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research*

*Disclosure*, Vol. 176, December 1978, Item 17643, XXIII. Image transfer systems.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in U.S. patent application Ser. No. 09/388,573 filed Sept. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The blocked compounds of this invention may be used in photographic elements that contain any or all of the features discussed above, but are intended for different forms of processing. These types of systems will be described in detail below.

Type I: Thermal process systems (thermograph and photothermographic), where processing is initiated solely by the application of heat to the imaging element.

Type II: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing. Types I and II will now be discussed.

Type I: Dry or Substantially Dry Thermographic and Photothermographic Systems

In accordance with one aspect of this invention the blocked developer is incorporated in a photothermographic element. Photothermographic elements of the type described in *Research Disclosure* 17029 are included by reference. The photothermographic elements may be of type A or type B as disclosed in *Research Disclosure* I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline,, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1 -methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1, 2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

A reducing agent in addition to the blocked developer may be included. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid,-and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzene-sulfon-amido-phenol, and p-benzenesulfonamidophenol; 2-phenylindane-1, 3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a toning agent, also known as an activator-toner or toner-accelerator. (These may also function as thermal solvents or melt formers.) Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent application Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent application Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In accordance with one aspect of this invention the blocked developer is incorporated in a thermographic element. In thermographic elements an image is formed by imagewise heating the element. Such elements are described in, for example, *Research Disclosure*, June 1978, Item No. 17029 and U.S. Pat. Nos. 3,080,254, 3,457,075 and 3,933,508, the disclosures or which are incorporated herein by reference. The thermal energy source and means for imaging can be any imagewise thermal exposure source and means that are known in the thermographic imaging art. The thermographic imaging means can be, for example, an infrared heating means, laser, microwave heating means or the like.

Type II: Low Volume Processing:

In accordance with another aspect of this invention the blocked developer is incorporated in a photothermographic element intended for low volume processing. Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Thermal development may be followed by bleach-fixing, to remove silver or silver halide, washing and drying, for example to improve subsequent scanning or to obtain archival film.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e.,,noise) are common approaches to'enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al. U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records-red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming-majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the world Wide Web of the Internet computer network.

Using an arrangement of the type shown in FIG. 1, the images contained in color negative elements in accordance with the invention are converted to digital form, manipulated, and recreated in a viewable form. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
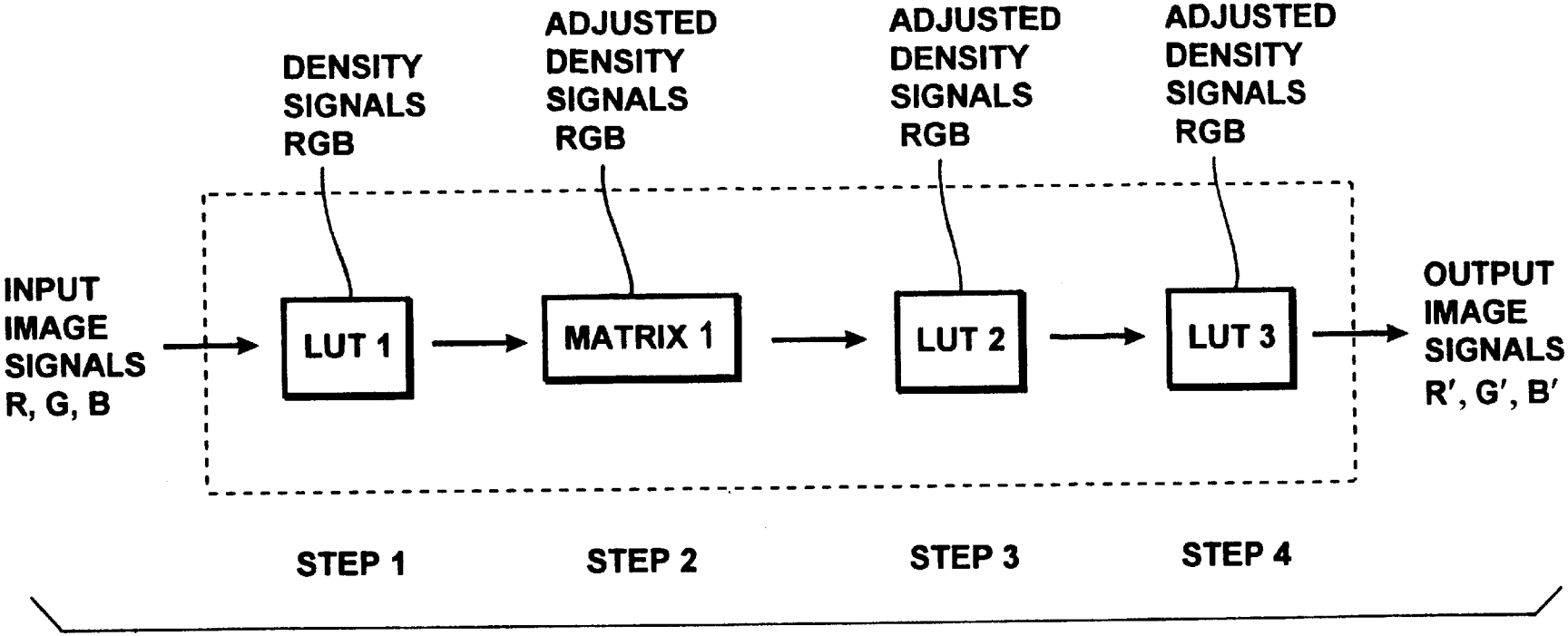
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred embodiment of the invention, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

In yet another embodiment of the invention, the luminance and chrominance sensitization and image extraction article and method described by Arakawa et al in U.S. Pat. No. 5,962,205 can be employed. The disclosures of Arakawa et al are incorporated by reference.

EXAMPLE 1

This example illustrates the preparation of a Blocked Developer B (referred to as compound D-3) that can be used in the present invention, which blocked developer is represented by the following structure:

D-105

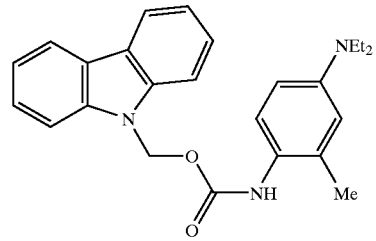

Compound D-105 is prepared according to the following reaction scheme, starting with compound a commercially available.

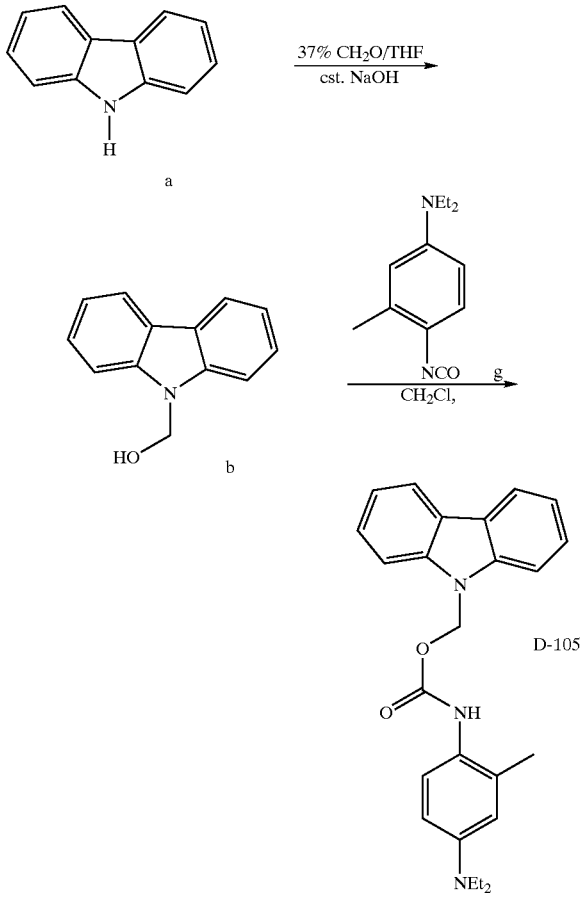

Preparation of Compound (b)

To a mixture of a (16.72 g, 100 mmol), THF (120 mL) were added 37% aqueous solution of formalin (13 mL) and two drops of 50% NaOH. The reaction mixture was stirred at room temperature for 8 hours and poured into water (650 mL). The solid material was isolated by filtration to give 18.11 g (92%) of the b.

Preparation of Compound (D-105)

To a mixture of b (9.87 g, 50 mmol), methylene chloride (40 mL) and two drops of dibutyltin diacetate was added c (10.81 g, 52 mmol). After being stirred at room temperature for 14 hours, the reaction mixture was concentrated under reduced pressure and diluted with the mixture of ligroin and ethyl acetate (4:1).

The solid material was isolated by filtration to give 17.84 g (89%) of D-105, $^1$H NMR (300 MHz, $CDCl_3$): 1.11 (t, J=7.3 Hz, 6H), 2.10 (s, 3H), 3.27 (q, J=7.3 Hz, 4H), 6.12 (s, 1H), 6.28–6.59 (m, 4H), 7.15–7.35 (m, 3H), 7.39–7.56 (m, 2H), 7.42–7.55 (t, 2H), 7.65–7.74 (d, 2H), 8.06 (d, 2H).

EXAMPLE 2

This example illustrates the synthesis of a representative Blocked Developer A useful in the invention. This compound is referred to above as blocked developing agent D-10, and is prepared according to the following reaction scheme:

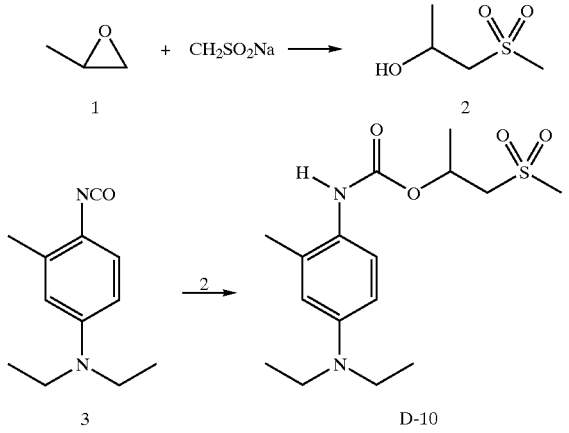

Propylene oxide (1, 7.2 mL, 105 mmol), sodium methanesulfinate (9.19 g, 90 mmol), and monobasic sodium phosphate monohydrate (16.56 g) were heated in 100 mL of water at 90° C. for 18 h. The solution was cooled and extracted with 4×100 mL of ethyl acetate. The extracts were dried over sodium sulfate and concentrated to a solid. The yield of 2 was 6.42 g (46 mmol, 52%).

A solution of 2 (3.32 g, 24 mmol), compound 3 (4.08 g, 20 mmol), and dibutyltin diacetate (0.05 mL) in 60 mL of 1,2-dichloroethane was stirred at room temperature for 7 days. The crude reaction mixture was purified by column chromatography on silica gel. The yield of D-10 was 6.15 g (18 mmol, 90%), m.p. 80–82° C., ESMS: ES+m/z 343 (M+1, 100%).

EXAMPLE 3

A representative synthesis blocked developers of Structure III of the invention is described below.

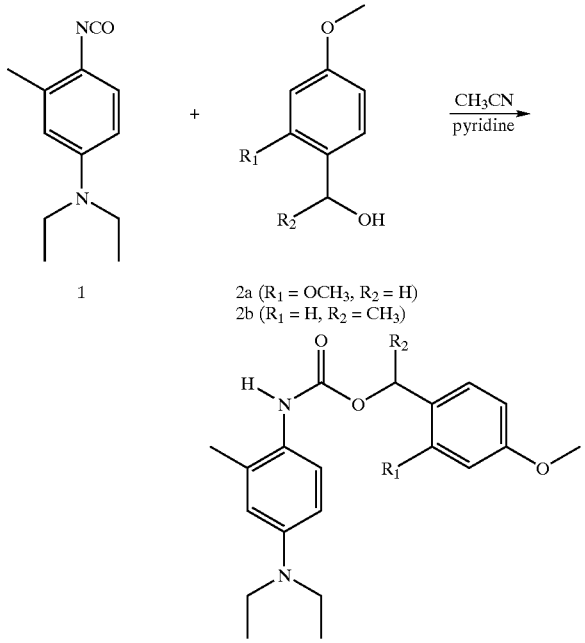

D-56 ($R_1$ = $OCH_3$, $R_2$ = H)
D-55 ($R_1$ = H, $R_2$ = $CH_3$)

Preparation of D-56

A solution of 1 (2.04 g, 10 mmol), 2a (1.83 g, 12 mmol) and pyridine (0.1 mL) in acetonitrile (25 mL) was refluxed for 18 h. The mixture was cooled, filtered and concentrated in vacuo. The crude product was purified by column chromatography, giving 1.89 g (5.3 mmol, 53%) of D-56, m.p. 90–92° C., APMS: AP+m/z 357 (M+1, 75%).

Preparation of D-55.

Prepared as described for D-56 from 1 and 2b. The yield: 62%, m.p. 90–91° C., ESMS: ES+m/z 373 (M+1, 100%).

EXAMPLE 4

This example illustrates the synthesis of another representative locked developer useful in the invention. This compound is referred to above as developing agent D-12, and is prepared according to the following reaction scheme:

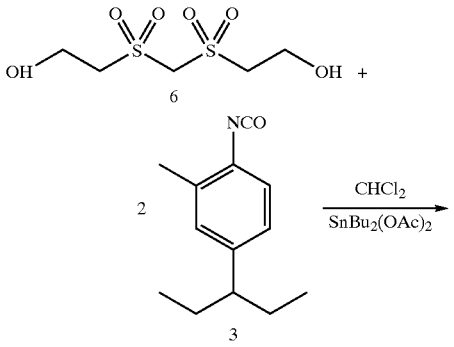

-continued

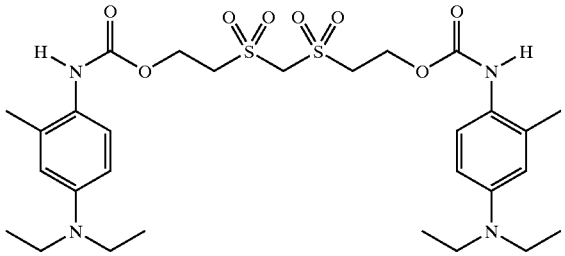

Compounds 2 and 6 are commercially available. Dibutyltin diacetate is also commercially available. The crude reaction mixture can be purified by column chromotography on silica gel. The resulting Compound BD-28 is thusly obtained in good yield.

EXAMPLE 5

This Example illustrates the performance of a compound according to the present invention in a photographic element. The processing conditions are as described below with respect to each sample. Unless otherwise stated, the silver halide was removed after development by immersion in Kodak Flexicolor Fix solution. In general, an increase of approximately 0.2 in the measured density would be obtained by omission of this step. The following components are used in the samples, including is a list of all of the chemical structures.

Coating Format

The inventive coating examples were prepared on a 7 mil thick poly(ethylene terephthalate) support and comprised an emulsion containing layer (contents shown below) with an overcoat layer of gelatin (0.22 g/m$^2$) and 1,1'-(methylenebis (sulfonyl))bis-ethene hardener (at 2% of the total gelatin concentration). Both layers contained spreading aids to facilitate coating.

TABLE 5-1

| Component | Laydown |
|---|---|
| Silver (from emulsion E-1) | 0.54 g/m$^2$ |
| Silver (from emulsion E-2) | 0.22 g/m$^2$ |
| Silver (from emulsion E-3) | 0.16 g/m$^2$ |
| Silver (from emulsion E-4) | 0.11 g/m$^2$ |
| Silver (from silver salt SS-1) | 0.32 g/m$^2$ |
| Silver (from silver salt SS-2) | 0.32 g/m$^2$ |
| Coupler M-1 (from coupler dispersion Disp-1) | 0.54 g/m$^2$ |
| Developer | 2.69 mMole/m$^2$ |
| Salicylanilide | 0.86 g/m$^2$ |
| Lime processed gelatin | 4.3 g/m$^2$ |

The common components in the structure were as follows:

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver Salt Dispersion SS-2

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 1 solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsions

Silver halide emulsions were prepared by conventional means to have the following morphologies and compositions. The emulsions were spectrally sensitized to green light by addition of sensitizing dyes and then chemically sensitized for optimum performance.

E-1: a tabular emulsion with composition of 96% silver bromide and 4% silver iodide and an equivalent circular diameter of 1.2 microns and a thickness of 0.12 microns E-2: a tabular emulsion with composition of 98% silver bromide and 2% silver iodide and an equivalent circular diameter of 0.45 microns and a thickness of 0.006 microns.

E-3: a tabular emulsion with composition of 98% silver bromide and 2% silver iodide and an equivalent circular diameter of 0.79 microns and a thickness of 0.009 microns.

E-4: a cubic emulsion with composition of 97% silver bromide and 3% silver iodide and size of 0.16 microns.

Coupler Dispersion Disp-1

An oil based coupler dispersion was prepared containing coupler M-1 , tricresyl phosphate and 2-butoxy-N,N-dibutyl-5-(1,1,3,3-tetramethylbutyl)-benzenamine, at a weight ratio of 1:0.8:0.2.

Coupler M1

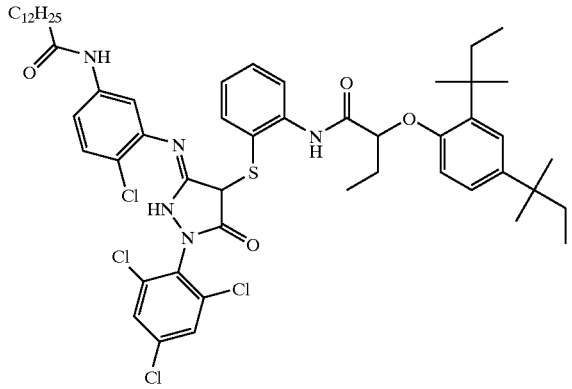

High To Developer Dev-:1 the high To incorporated developer D-12 had the following structure:

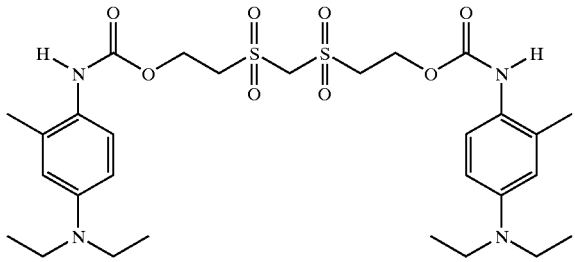

This material was ball-milled in an aqueous mixture, for 4 days using Zirconia beads in the following formula. For 1 g of Incorporated developer, sodium tri-isopropylnaphthalene sulfonate (0.1 g ), water (to 10 g), and beads (25 ml), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

Low to Incorporated Developer (Dev-2)

This material was incorporated in the same way as for Dev-1. The structure of the low To incorporated developer is D-104.

Coating Evaluation

The resulting coatings were exposed through a step wedge to a 3.04 log lux light source at 3000K filtered by Daylight 5A, 0.6 Inconel and Wratten 9 filters. The exposure time was 0.1 seconds. After exposure, the coating was thermally processed by contact with a heated platen for 20 seconds. A number of strips were processed at a variety of platen temperatures in order to check the generality of the effects that were seen. Density measurements were made at each step and from these data, two parameters were obtained:

A. Onset Temperature, $T_o$: Corresponds the temperature required to produce a maximum density (Dmax) of 0.5. Lower temperatures indicate more active developers which are desirable.

B. Peak Discrimination, $D_p$: For the optimum platen temperature, the peak discrimination corresponds to the value:

$$D_p = \frac{D_{max} - D_{min}}{D_{min}}$$

High values of $D_p$ indicate the developer produces good signal to noise, which is desirable.

The coatings shown above performed as shown in the Table 5-2 below.

TABLE 5-2

| Coating | Developer | $T_0$ (° C.) | Dp |
|---|---|---|---|
| I-1 | Dev-1 | 135 | 9.6 |
| I-2 | 80% Dev-1 + 20% Dev-2 | 116 | 5.0 |
| I-3 | Dev-2 | 110 | 2.0 |

These data show that by incorporating Dev-2 into coatings containing Dev-1, the onset temperature can be greatly reduced (by 19° C.) while maintaining a good peak discrimination.

EXAMPLE 6

This used a similar coating structure and similar components to those in Example 6 with the following changes:

The emulsions were spectrally sensitized to blue light by addition of sensitizing dyes and then chemically sensitized for optimum performance.

E-5 replaced E-1: and was a tabular emulsion with composition of 98% silver bromide and 2% silver iodide and an equivalent circular diameter of 1.2 microns and a thickness of 0.12 microns E-6 replaced E-2: and was a tabular emulsion with composition of 98% silver bromide and 2% silver iodide and an equivalent circular diameter of 0.45 microns and a thickness of 0.006 microns.

E-7 replaced E-3: and was a tabular emulsion with composition of 98% silver bromide and 2% silver iodide and an equivalent circular diameter of 0.79 microns and a thickness of 0.009 microns.

E-8 replaced E4: and was a cubic emulsion with composition of 97% silver bromide and 3% silver iodide and size of 0.16 microns.

Salicylanilide was coated at 0.65 g/m$^2$

Coupler Y-1 replaced M-1. An oil based coupler dispersion was prepared containing coupler Y-1, 1,2-benzenedicarboxylic acid, dibutyl ester, at a weight ratio of 1:0.5.

Y-1

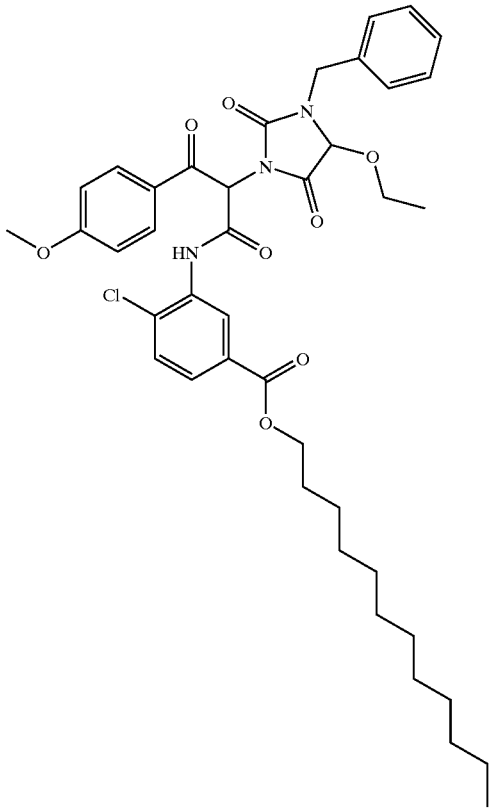

The Coating Evaluation

The resulting coatings were exposed through a step wedge to a 3.04 log lux light source at 3000K filtered by Daylight 5A, and Wratten 2B filters. The exposure time was 0.1 seconds. After exposure, the coating was thermally processed by contact with a heated platen for 20 seconds. A number of strips were processed at a variety of platen temperatures in order to check the generality of the effects that were seen. The coatings described above performed as shown in the Table 6-1 below.

TABLE 6-1

| Coating | Developer | $T_0$ (° C.) | Dp |
|---|---|---|---|
| I-4 | Dev-1 | 141 | 7.7 |
| I-5 | 90% Dev-1 + 10% Dev-2 | 137 | 5.1 |
| I-6 | 80% Dev-1 + 20% Dev-2 | 135 | 4.1 |
| I-7 | 50% Dev-1 + 50% Dev-2 | 131 | 3.7 |
| I-8 | Dev-2 | 122 | 2.5 |

Difference is 5.2

The reduction in onset temperature with increasing level of Dev-2 can be seen. In particular, a decrease in 10° C. is obtained by using 50% of Dev-2.

EXAMPLE 7

The following components were used in the creation of the sample photographic element of this example:

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Emulsion E-1

A silver halide tabular emulsion was precipitated by means known in the art. The emulsion contained 98% silver bromide and 2% silver iodide, and had dimensions of 1.2 microns in effective circular diameter by 0.12 microns in thickness. The emulsion was spectrally sensitized to green light by addition of dyes SM-1 and SM-2, and then was chemically sensitized to an optimum position as is known in the art.

Coupler Dispersion CDM-1

A coupler dispersion was prepared by conventional means containing coupler M-1 without any additional permanent solvents.

M-1

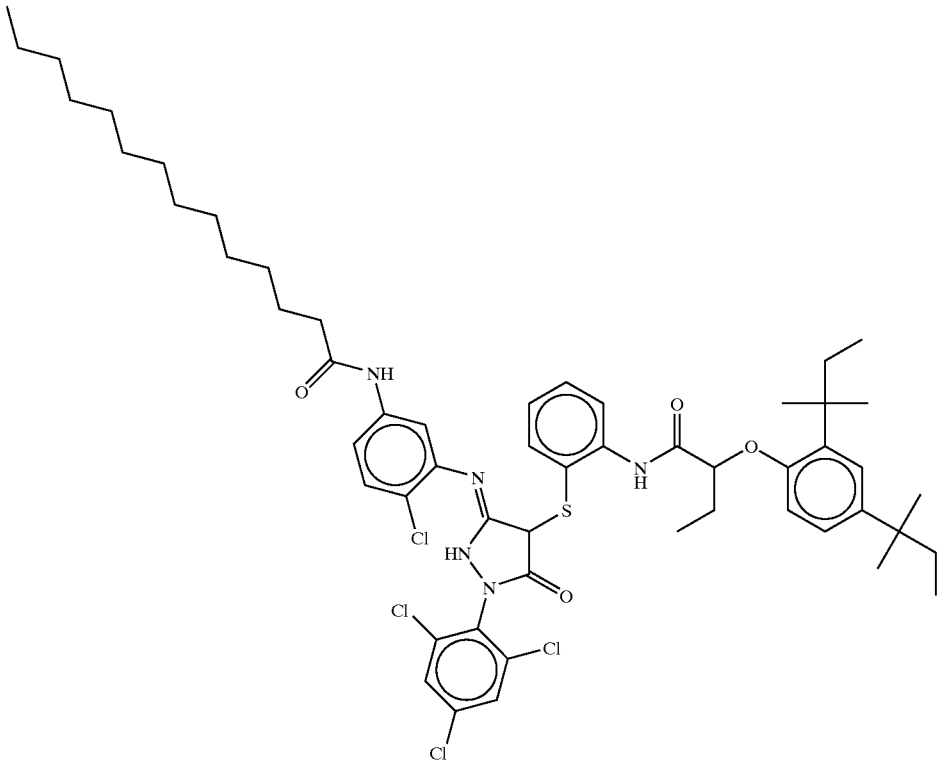

-continued

SM-1

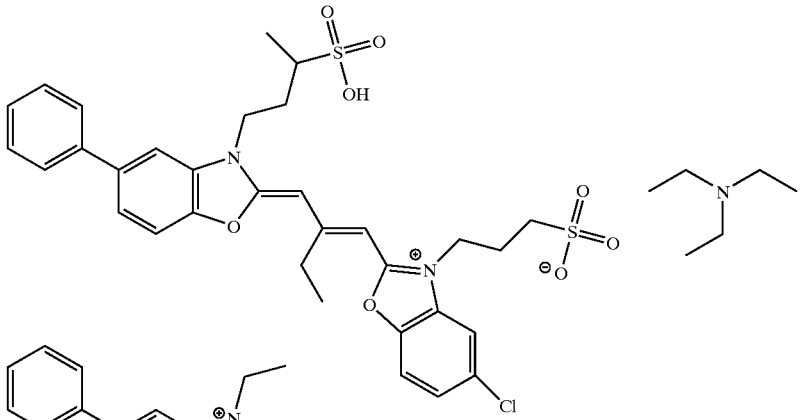

SM-2

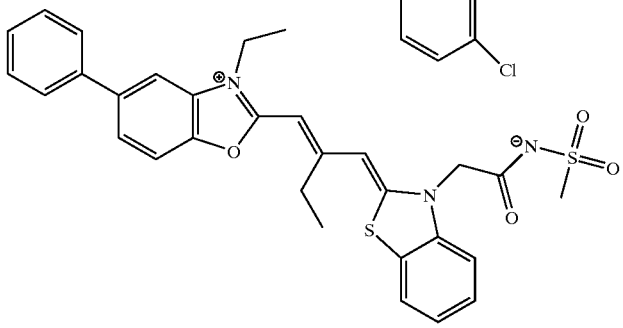

All coatings for this example contain a single light sensitive layer and were prepared according to the format listed in Table 7-1, with variations consisting of changing the incorporated developer. The total developer laydown was kept constant in all coatings at 2.21 mmols/m$^2$, while the ratio of developer types was varied. All coatings were prepared on a 7 mil thick poly(ethylene terephthalate) support.

TABLE 7-1

| Component | Laydown |
|---|---|
| Silver (from emulsion E-1) | 0.86 g/m$^2$ |
| Silver (from silver salt SS-1) | 0.32 g/m$^2$ |
| Silver (from silver salt SS-2) | 0.32 g/m$^2$ |
| Coupler M-1 (from coupler dispersion CDM-1) | 0.54 g/m$^2$ |
| Salicylanilide | 0.86 g/m$^2$ |
| Lime processed gelatin | 4.31 g/m$^2$ |

The developers listed in table 7-2 below were tested in combination. Developers were ball-milled in an aqueous slurry for 3 days using Zirconia beads in the following formula. For each gram of incorporated developer, 0.2 g of sodium tri-isopropylnaphthalene sulfonate, 10 g of water, and 25 ml of beads were added. Following milling, the zirconia beads were removed by filtration. The slurry was refrigerated prior to use.

TABLE 7-2

D-12

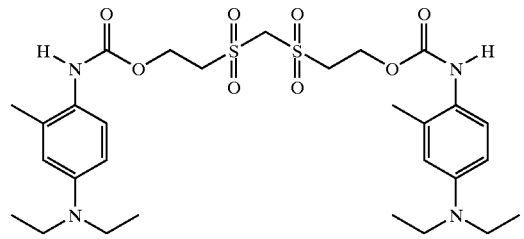

D-18

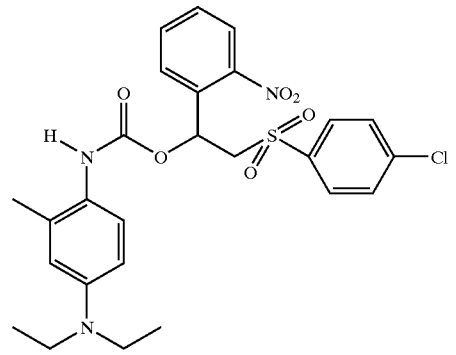

The resulting coatings were exposed through a step wedge to a 3.04 log lux light source at 3000K filtered by Daylight 5A and Wratten 2B filters. The exposure time was 1 second. After exposure, the coating was thermally processed by contact with a heated platen for 20 seconds. A number of strips were processed at a variety of platen temperatures in order to yield an optimum strip process condition. From this data, two parameters were obtained:

A. Onset Temperature, $T_o$

Corresponds the temperature required to produce a maximum density (Dmax) of 0.5. Lower temperatures indicate more active developers which are desirable.

B. Peak Discrimination, $D_p$

For the optimum platen temperature, the peak discrimination corresponds to the value:

$$D_p = \frac{D_{max} - D_{min}}{D_{min}}$$

Higher values of $D_p$ indicate developers producing enhanced signal to noise, which are desirable.

Table 7-3 shows the results for the coatings used in this example. Items listed are the percentages of each of developers D-1 and D-2, the onset temperature $T_o$, and the relative discrimination, $D_p$.

TABLE 7-3

| Coating | % D-1 | % D-2 | $T_0$ (° C.) | $D_P$ |
|---|---|---|---|---|
| 1-1 | 100 | 0 | 136.0 | 5.21 |
| 1-2 | 67 | 33 | 137.5 | 7.66 |
| 1-3 | 33 | 67 | 141.0 | 7.82 |
| 1-4 | 0 | 100 | 151.7 | 5.72 |

It can be seen by examination of Table 8-3 that the combination of blocked developers D-1 and D-2 yields onset temperatures lower than that of developer D-2 alone while providing superior image discrimination to either blocked developer alone.

EXAMPLE 8

To further illustrate the advantage of the invention, a photothermographic element was constructed on polyethyleneterephthalate support with the following components:

TABLE 8-1

| Component | Laydown |
|---|---|
| Silver (from emulsion E-2) | 0.86 g/m$^2$ |
| Silver (from silver salt SS-1) | 0.64 g/m$^2$ |
| 5-phenyl-1-mercaptotetrazole | 0.32 g/m$^2$ |
| Coupler M-2 | 0.54 g/m$^2$ |
| Lime processed gelatin | 4.31 g/m$^2$ |

Emulsion E-2 is a silver halide tabular emulsion with a composition of 98.7% silver bromide and 1.3% silver iodide, prepared by conventional means. The resulting emulsion had an equivalent circular diameter of 0.6 microns and a thickness of 0.09 microns. This emulsion was spectrally sensitized to yellow light by addition of dye Y-2 and then chemically sensitized for optimum performance. The structure of coupler M-2 is given below. It was incorporated into the photothermographic coatings as an oil-in-water dispersion using tricresyl phosphate as a coupler solvent in the manner well known in the art.

Y-2

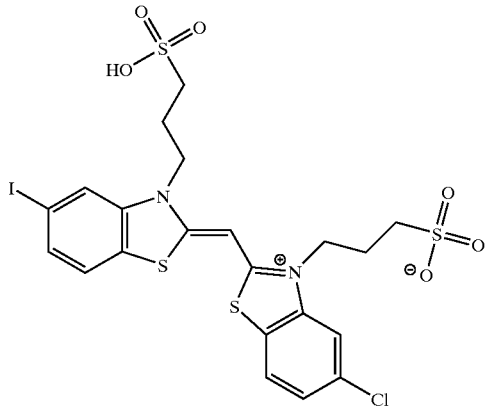

M-2

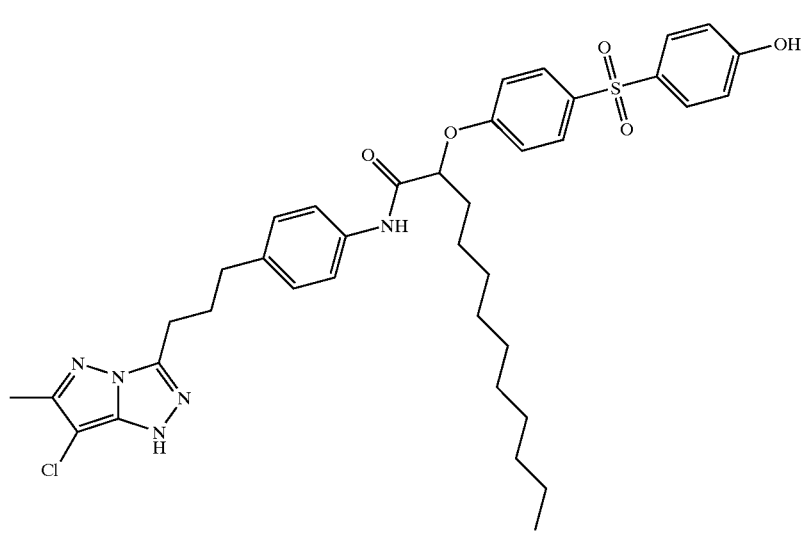

In addition to the above components, each coating also contained developer D-28 or D94BR, or a mixture of the two developers as given in Table 8-3.

TABLE 8-2

D-12

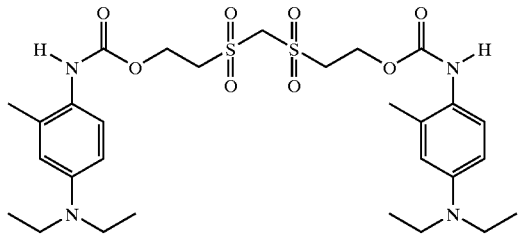

D-55

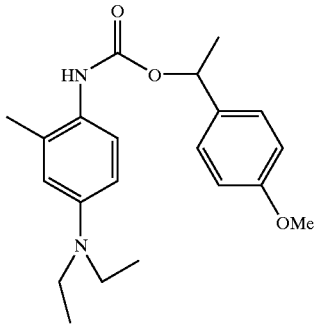

TABLE 8-3

| Coating | Amount of Developer D-12 | Amount of Developer D-55 |
|---|---|---|
| 9-1 | 0.75 g/m$^2$ | 0 g/m$^2$ |
| 9-2 | 0 g/m$^2$ | 0.83 g/m$^2$ |
| 9-3 | 0.60 g/m$^2$ | 0.17 g/m$^2$ |
| 9-4 | 0.45 g/m$^2$ | 0.33 g/m$^2$ |
| 9-5 | 0.30 g/m$^2$ | 0.50 g/m$^2$ |

The resulting coatings were exposed through a step wedge to a 3.04 log lux light source at 3000K filtered by Daylight 5A and Wratten 2B filters. The exposure time was 1 second. Following exposure, the coatings were thermally processed by contact with a heated platen for 20 seconds. A number of strips were processed at a variety of platen temperatures in order to yield an optimum strip process condition. The peak discrimination at a process temperature of 150 degrees C. is given in Table 9-2. Also presented in Table 9-2 is the temperature sensitivity exhibited by each photothermographic coating. The temperature sensitivity is defined as the slope of the peak discrimination versus process temperature. A slope near zero is desired, as it indicates little change in peak discrimination as the process temperature is varied.

TABLE 8-3

| Coating | Developer | $T_0$ | $D_p$ (150° C.) | Temperature Sensitivity |
|---|---|---|---|---|
| 9-1 | D-12 (Comparison) | 135 | 2.86 | 0.21 |
| 9-2 | D-55 (Comparison) | 150 | 1.12 | 0.17 |
| 9-3 | Mixture 1 (Inv.) | 138 | 3.73 | 0.16 |
| 9-4 | Mixture 2 (Inv.) | 140 | 4.12 | 0.13 |
| 9-5 | Mixture 3 (Inv.) | 142 | 3.77 | 0.01 |

It is clear from these examples that photothermographic elements that contain a mixture of two developers exhibit improved relative discrimination compared to either developer when used alone. In addition, the inventive combinations effectively lower the onset temperature for the blocked developer with the higher $T_o$. Furthermore, the photothermographic elements that use a mixture of developers exhibit lower sensitivity to temperature, rendering them more robust to temperature variations in the processing equipment.

EXAMPLE 9

This example demonstrates the advantageous use of a combination of blocked developer in a multilayer film element intended for multiple color capture and reproduction. The following components were used in the creation of this example.

Silver Salt SS-1 (as Described in Example 7)

Silver Salt Dispersion SS-2

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 1 solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

TABLE 9-1

| Emulsion | Spectral sensitivity | Iodide content (%) | Diameter (μm) | Thickness (μm) | Dyes |
|---|---|---|---|---|---|
| EY-1 | yellow | 4 | 1.97 | 0.13 | SY-1 |
| EY-2 | yellow | 2 | 1.23 | 0.125 | SY-1 |
| EY-3 | yellow | 2 | 0.42 | 0.061 | SY-1 |
| EY-4 | yellow | 1.95 | 0.653 | 0.092 | SY-1 |
| EY-5 | yellow | 3.4 | 0.16 (cube) | | SY-1 |
| EY-6 | yellow | 3.4 | 0.10 (cube) | | SY-1 |
| EY-7 | yellow | 3.4 | 0.05 (cube) | | SY-1 |
| EM-1 | magenta | 4 | 1.97 | 0.13 | SM-1 + SM-2 |
| EM-2 | magenta | 4 | 1.25 | 0.106 | SM-1 + SM-2 |
| EM-3 | magenta | 2 | 0.42 | 0.061 | SM-1 + SM-2 |
| EM-4 | magenta | 1.95 | 0.653 | 0.092 | SM-1 + SM-2 |
| EM-5 | magenta | 3.4 | 0.16 (cube) | | SM-1 + SM-2 |
| EM-6 | magenta | 3.4 | 0.10 (cube) | | SM-1 + SM-2 |
| EM-7 | magenta | 3.4 | 0.05 (cube) | | SM-1 + SM-2 |
| EC-1 | cyan | 4 | 1.97 | 0.13 | SC-1 + SC-2 |
| EC-2 | cyan | 4 | 1.25 | 0.106 | SC-1 + SC-2 |
| EC-3 | cyan | 2 | 0.42 | 0.061 | SC-1 + SC-2 |
| EC-4 | cyan | 1.95 | 0.653 | 0.092 | SC-1 + SC-2 |
| EC-5 | cyan | 3.4 | 0.16 (cube) | | SC-1 + SC-2 |
| EC-6 | cyan | 3.4 | 0.10 (cube) | | SC-1 + SC-2 |
| EC-7 | cyan | 3.4 | 0.05 (cube) | | SC-1 + SC-2 |

Coupler Dispersion CDM-1

A coupler dispersion was prepared by conventional means containing coupler M-1 without any additional permanent solvents.

Coupler Dispersion CDC-1

An oil based coupler dispersion was prepared by conventional means containing coupler C-1 and dibutyl phthalate at a weight ratio of 1:2.

Coupler Dispersion CDY-1

An oil based coupler dispersion was prepared by conventional means containing coupler Y-1 and dibutyl phthalate at a weight ratio of 1:0.5.

Y-1
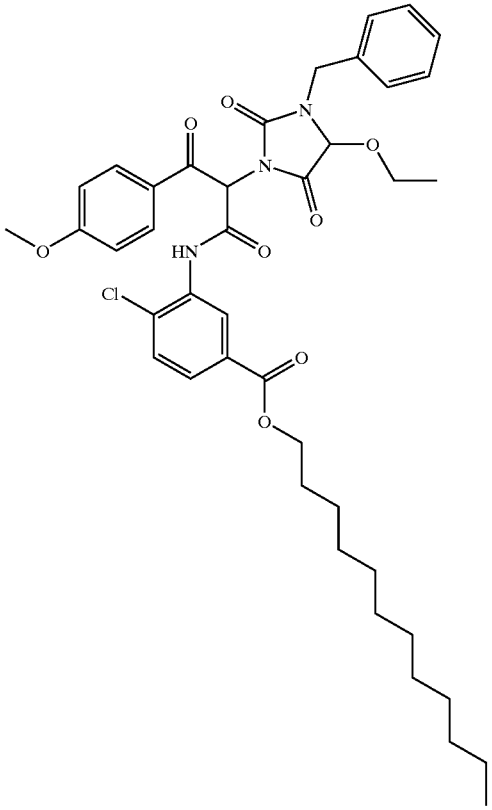
M-1
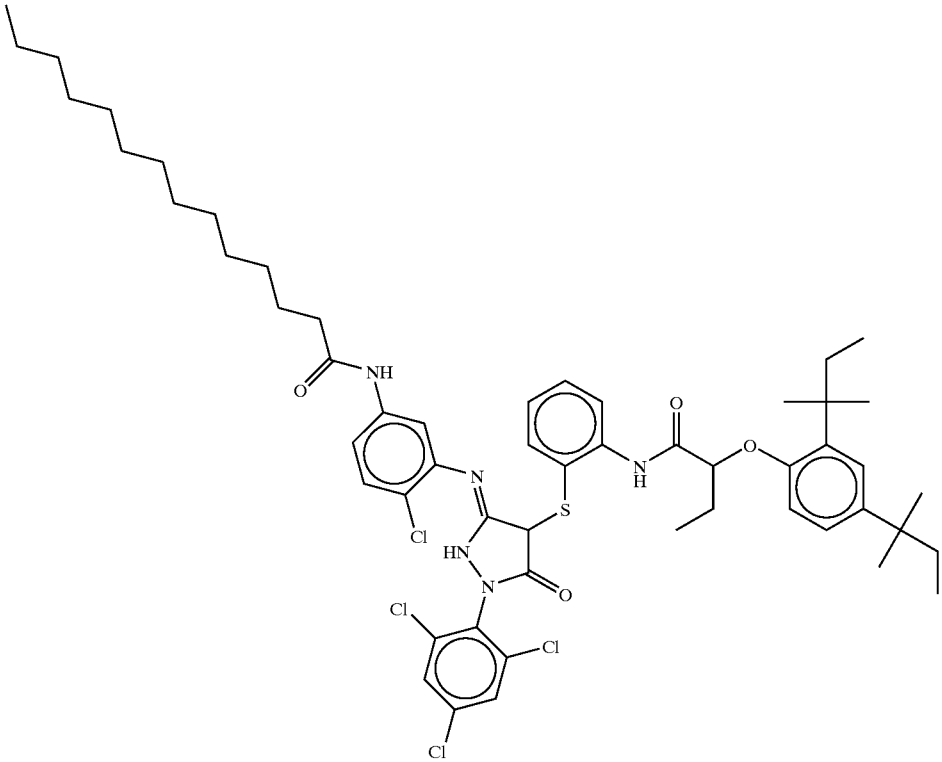

-continued
C-1
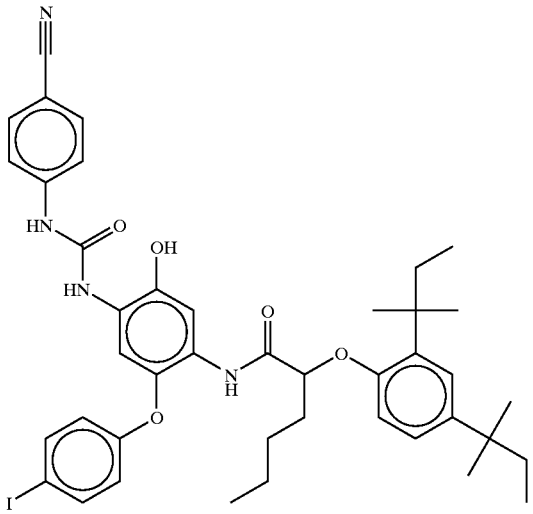
SY-1
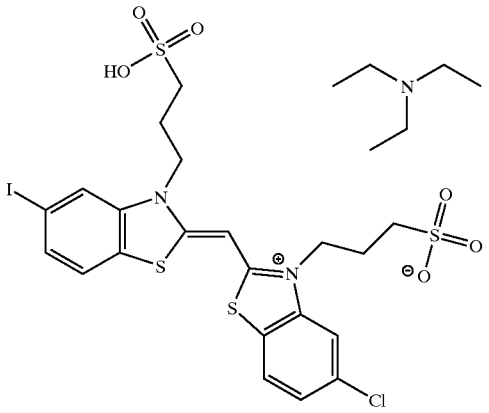
SY-2
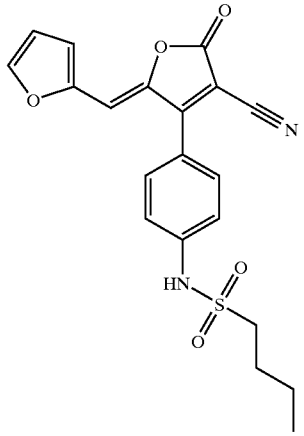

-continued
SM-1
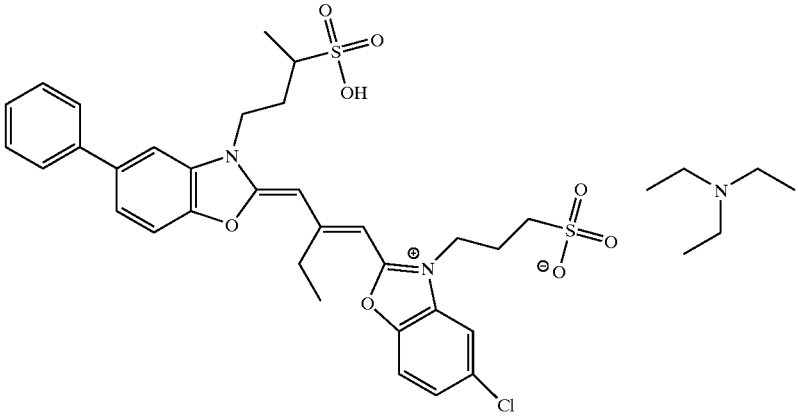
SM-2
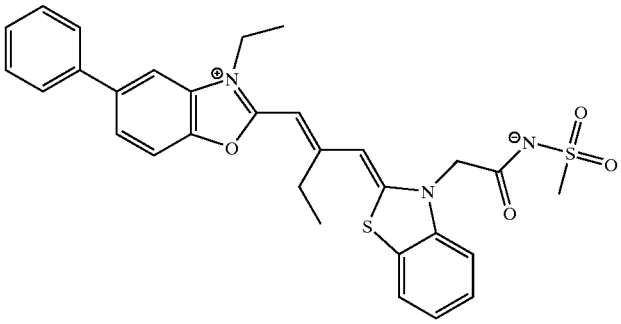
SC-1
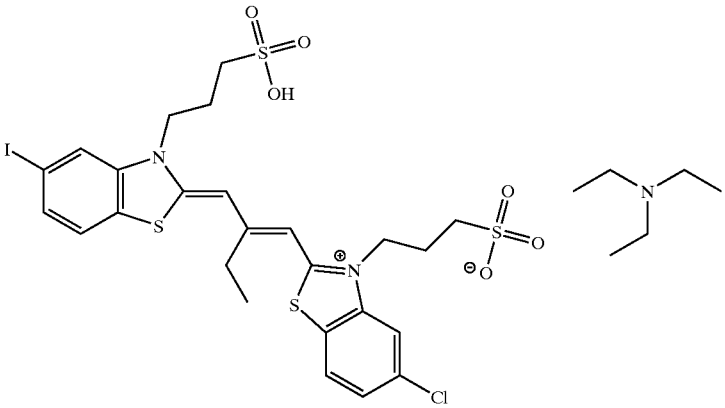
SC-2
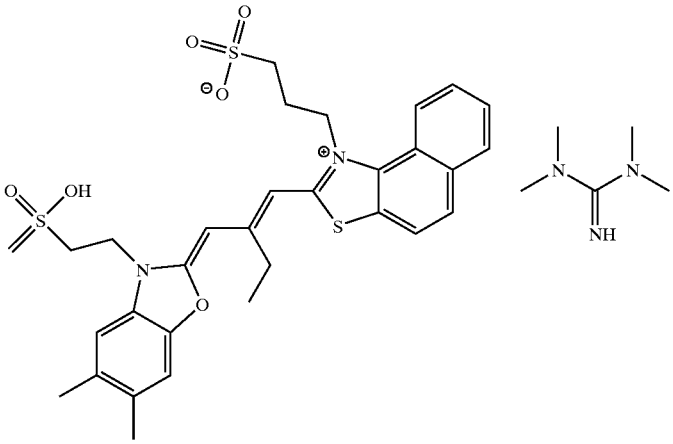

-continued

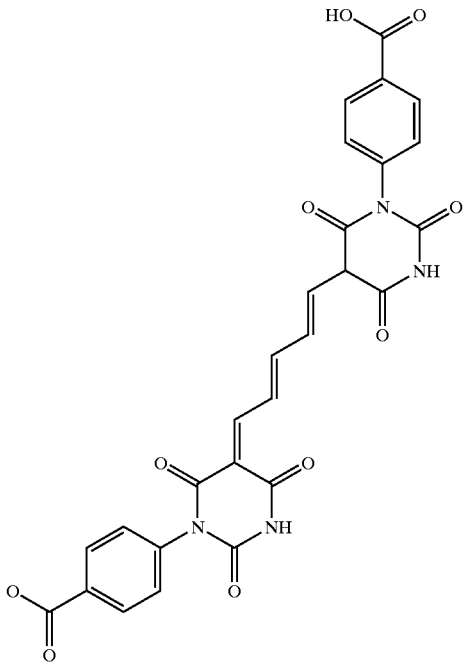

AD-1

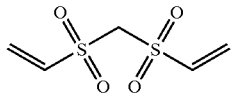

Hardener-1

A basic multilayer imaging element as described in table 2-2 was created. Variations in coating examples consisted of changing the respective amounts of developing agents D-1 and D-2 while maintain the overall molar laydowns of developer as listed in Table 10-2 below. The composition of the test coatings is shown in Table 10-3.

TABLE 9-2

| Overcoat | 1.1 g/m$^2$ Gelatin<br>0.32 g/m$^2$ Hardener-1 |
|---|---|
| Fast Yellow | 0.48 g/m$^2$ AgBrI from emulsion EY-1<br>0.15 g/m$^2$ silver benzotriazole from SS-1<br>0.15 g/m$^2$ silver-1-phenyl-5-mercaptotetrazole from SS-2<br>0.21 g/m$^2$ coupler Y-1 from dispersion CDY-1<br>1.61 mmol/m$^2$ Total Developer<br>0.52 g/m$^2$ Salicylanilide<br>1.56 g/m$^2$ Gelatin |
| Slow Yellow | 0.22 g/m$^2$ AgBrI from emulsion EY-2<br>0.11 g/m$^2$ AgBrI from emulsion EY-3<br>0.092 g/m$^2$ AgBrI from emulsion EY-4<br>0.065 g/m$^2$ AgBrI from emulsion EY-5<br>0.065 g/m$^2$ AgBrI from emulsion EY-6<br>0.43 g/m$^2$ AgBrI from emulsion EY-7<br>0.24 g/m$^2$ silver benzotriazole from SS-1<br>0.24 g/m$^2$ silver-1-phenyl-5-mercaptotetrazole from SS-2<br>0.39 g/m$^2$ coupler Y-1 from dispersion CDY-1<br>1.80 mmol/m$^2$ Total Developer<br>0.58 g/m$^2$ Salicylanilide<br>2.75 g/m$^2$ Gelatin |
| Yellow Filter | 0.13 g/m$^2$ SY-2<br>1.08 g/m$^2$ Gelatin |
| Fast Magenta | 0.48 g/m$^2$ AgBrI from emulsion EM-1<br>0.15 g/m$^2$ silver benzotriazole from SS-1<br>0.15 g/m$^2$ silver-1-phenyl-5-mercaptotetrazole from SS-2<br>0.21 g/m$^2$ coupler M-1 from dispersion CDM-1<br>0.90 mmol/m$^2$ Total Developer |

TABLE 9-2-continued

| Overcoat | 1.1 g/m$^2$ Gelatin<br>0.32 g/m$^2$ Hardener-1 |
|---|---|
| | 0.29 g/m$^2$ Salicylanilide<br>1.56 g/m$^2$ Gelatin |
| Slow Magenta | 0.22 g/m$^2$ AgBrI from emulsion EM-2<br>0.11 g/m$^2$ AgBrI from emulsion EM-3<br>0.11 g/m$^2$ AgBrI from emulsion EM-4<br>0.11 g/m$^2$ AgBrI from emulsion EM-5<br>0.065 g/m$^2$ AgBrI from emulsion EM-6<br>0.065 g/m$^2$ AgBrI from emulsion EM-7<br>0.24 g/m$^2$ silver benzotriazole from SS-1<br>0.24 g/m$^2$ silver-1-phenyl-5-mercaptotetrazole from SS-2<br>0.39 g/m$^2$ coupler M-1 from dispersion CDM-1<br>0.96 mmol/m$^2$ Total Developer<br>0.31 g/m$^2$ Salicylanilide<br>2.75 g/m$^2$ Gelatin |
| Interlayer | 1.07 g/m$^2$ Gelatin |
| Fast Cyan | 0.48 g/m$^2$ AgBrI from emulsion EC-1<br>0.15 g/m$^2$ silver benzotriazole from SS-1<br>0.15 g/m$^2$ silver-1-phenyl-5-mercaptotetrazole from SS-2<br>0.21 g/m$^2$ coupler C-1 from dispersion CDC-1<br>1.61 mmol/m$^2$ Total Developer<br>0.52 g/m$^2$ Salicylanilide<br>1.56 g/m$^2$ Gelatin |
| Slow Cyan | 0.22 g/m$^2$ AgBrI from emulsion EC-2<br>0.11 g/m$^2$ AgBrI from emulsion EC-3<br>0.11 g/m$^2$ AgBrI from emulsion EC-4<br>0.11 g/m$^2$ AgBrI from emulsion EC-5<br>0.065 g/m$^2$ AgBrI from emulsion EC-6<br>0.065 g/m$^2$ AgBrI from emulsion EC-7<br>0.24 g/m$^2$ silver benzotriazole from SS-1<br>0.24 g/m$^2$ silver-1-phenyl-5-mercaptotetrazole from SS-2<br>0.39 g/m$^2$ coupler C-1 from dispersion CDC-1<br>1.80 mmol/m$^2$ Total Developer<br>0.58 g/m$^2$ Salicylanilide<br>2.75 g/m$^2$ Gelatin |

TABLE 9-2-continued

| | |
|---|---|
| Overcoat | 1.1 g/m$^2$ Gelatin<br>0.32 g/m$^2$ Hardener-1 |
| Antihalation Layer | 0.108 g/m2 AD-1<br>1.6 g/m2 Gelatin |
| Support | Polyethylene terephthalate support (4 mil thickness) |

TABLE 9-3

| | Developer Fractions | |
|---|---|---|
| Coating | % Dev-1 | % Dev-2 |
| 2-1 | 100 | 0 |
| 2-2 | 50 | 50 |
| 2-3 | 0 | 100 |

The resulting coatings were exposed through a step wedge to a 2.1 log lux light source at 5500K and Wratten 2B filter. The exposure time was 0.1 seconds. The step wedge contained 21 steps each separated by 0.2 log(E), to yield on overall exposure range of 4.0 log(E).

After exposure, the coating was thermally processed by contact with a heated platen for 20 seconds at 154° C. Cyan, magenta, and yellow densities corresponding to each step were read using status M color profiles. The average gamma of the coatings were calculated for each record by regressing a linear fit to the densities formed from steps that exhibited densities above Dmin. Table 10-4 shows the measured gammas and Dmins of three coatings two of which have pure developers and the other having a combination of 50% of each of Dev-1 and Dev-2. Considering that a minimum gamma of approximately 0.3 is required for faithful image reproduction from a scanning operation, it can be seen that the inventive combination (example 2-2) containing a mixture of developers shows acceptable gamma while maintaining a low Dmin position. The comparative coating with Dev-1 alone (example C2-1) shows acceptable gamma but excessive Dmin while the comparative coating with Dev-2 alone (example C2-3) shows acceptable Dmin but insufficient gamma.

TABLE 9-4

| | Gamma | | | D min | | |
|---|---|---|---|---|---|---|
| Coating | Cyan | Magenta | Yellow | Cyan | Magenta | Yellow |
| 2-1 (Comp.) | 0.51 | 0.84 | 0.65 | 0.371 | 0.504 | 0.861 |
| 2-2 (Inv.) | 0.38 | 0.67 | 0.52 | 0.160 | 0.322 | 0.675 |
| 2-3 (Comp.) | 0.15 | 0.23 | 0.16 | 0.141 | 0.308 | 0.746 |

The invention has been described in detail with particular reference to preferred embodiments, but it will be understood that variations and modifications can be effected within the spirit and scope of the invention. In particular, the inventive developers can be used in one or more of the layers in full color, multi-layer film formats.

What is claimed is:

1. A photothermographic color element comprising at least three light-sensitive units that have their individual sensitivities in different wavelength regions comprising a silver halide imaging layer having associated therewith a mixture of at least two blocked developing agents comprising Blocked Developer A and Blocked Developer B independently represented by the following structure:

$$\text{DEV-(LINK 1)}_l\text{(TIME)}_m\text{-(LINK 2)}_n\text{-M}$$

wherein:

DEV is a silver halide color developing agent;

LINK 1 and LINK 2 are linking groups;

TIME is a timing group;

l is 0 or 1;

m is 0, 1, or 2;

n is 0 or 1;

l+n is 1 or 2;

M is a blocking group or M is:

$$\text{-M'-(LINK 2)}_n\text{-(TIME)}_m\text{-(LINK 1)}_l\text{-DEV}$$

wherein M' is blocking group for a second developing agent DEV; and where LINK 1 and LINK 2 have the following structure:

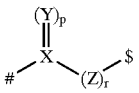

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2)

wherein the onset temperature of said blocked Developer B is less than the onset temperature of said blocked Developer A, the onset temperature of Developer B is in the range of 110 to 160° C. and the onset temperature of Developer A is 130 to 170° C. and wherein and the difference in the onset temperatures of the two developing agents are 5 to 50° C.

2. The photographic element of claim 1 wherein the difference in the onset temperatures of the two developing agents are 5 to 50° C.

3. A photothermographic color element according to claim 1 wherein the Dp of the mixture is higher than the Dp of Blocked Developer B.

4. A photothermographic color element according to claim 1 wherein the difference in Dp between blocked developers is less than 5.0.

5. A photothermographic color element according to claim 1 wherein Blocked Developer A is present in the amount of 1 to 99 percent by mole and Blocked Developer B is present in the amount of 99 to 1 percent by mole.

6. A photothermographic color element according to claim 1 wherein a third developing agent or a third and fourth developing agent is present.

7. A photothermographic color element according to claim 4 wherein the peak discrimination of the mixture is higher than the peak discrimination of either alone.

8. The photothermographic color element according to claim 1, wherein the developing agent is an aminophenol, phenylenediamine, hydroquinone, pyrazolidinone, or hydrazine.

9. The photothermographic color element according to claim 1, wherein the developer is a phenylenediamine.

10. A photothermographic color element according to claim 1, where LINK 1 and LINK 2 are the following:

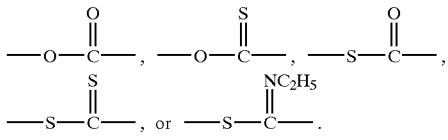

11. A photothermographic color element according to claim 1, wherein LINK 1 is

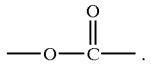

12. A photothermographic color element according to claim 1, wherein TIME is a timing group selected from (1) groups utilizing an aromatic nucleophilic substitution reaction; (2) groups utilizing the cleavage reaction of a hemiacetal; (3) groups utilizing an electron transfer reaction along a conjugated system; or (4) groups using an intramolecular nucleophilic substitution reaction.

13. A photothermographic color element of claim 1 wherein M in Blocked Developer B is:

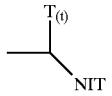

wherein

T represents t independently selected substituted or unsubstituted alkyl or aryl groups, t is 0, 1, or 2 and if t is 2, the T groups can form a ring; and NIT is a disubstituted nitrogen group which optionally can form a ring.

14. A photothermographic color element according to claim 13, wherein NIT is selected from the group consisting of: benzimidazolyl, benzothiazolyl, benzoxazolyl, benzothiophenyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, triazolyl, N,N-diarylamino, carbazolyl, and substituted derivatives thereof.

15. A photothermographic color element according to claim 13, wherein NIT is selected from the group consisting of: 1-imidazolyl, 1-benzimidazolyl, 1-pyrrolyl, 1-indolyl, 1-carbazolyl, 1-pyrazolyl, 1-indazolyl, N,N-diphenylamino, and 1-tetrahydrocarbazolyl , and substituted derivatives thereof.

16. A photothermographic color element according to claim 1, wherein the Blocked Developer B is of the following structure:

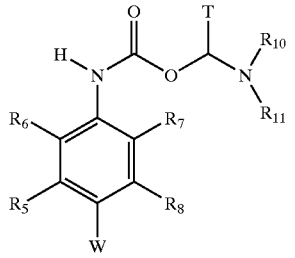

wherein:

NIT is a disubstituted nitrogen group which optionally can form a ring with a the T group;

wherein:

W is OH or $NR_2R_3$, and $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_4$ or $R_7$ to form a ring;

$R_9$ are independently hydrogen, alkyl, aryl, heteroaromatic or alkoxy groups, which can be connected with $R_{10}$ or $R_{11}$ to form a ring;

$R_{10}$ and $R_{11}$ are independently alkyl, aryl, substituted aryl or heteroaromatic subtituents which can be connected to form ring.

17. A photothermographic color element according to claim 1, wherein the Blocked Developer A or both Blocked Developer A and B is of the following structure:

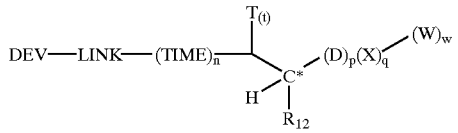

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($Sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1to C10 organic group (either an $R_{13}$ or an $R_{13}$ and $R_{14}$ group); or T is joined with W or $R_{12}$ to form a ring; or two T groups can combine to form a ring;

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group;

W is W' or a group represented by the following structure:

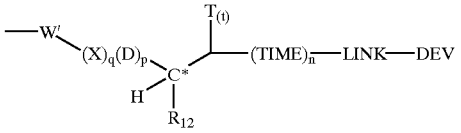

W' is independently selected from a substituted or unsubstituted (referring to the following W' groups) alkyl, cycloalkyl, aryl or heterocyclic group; and wherein W' in combination with T or $R_{12}$ can form a ring;

$R_{13}$, $R_{14}$, $R_{15}$, and $R_{16}$ can independently be selected from substituted or unsubstituted alkyl, aryl, or heterocyclic group; and any two members of the following set: $R_{12}$, T, and either D or W, that are not directly linked may be joined to form a ring, provided that creation of the ring will not interfere with the functioning of the blocking group.

18. A photothermographic color element according to claim 17, wherein the blocked developer is represented by the following structure:

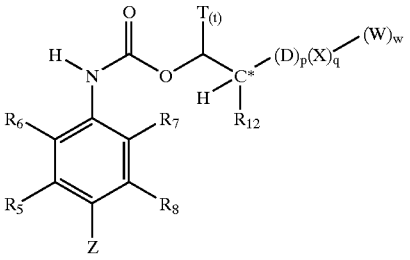

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following structure:

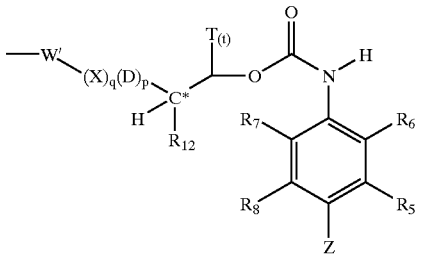

wherein T, t, C*, $R_{12}$, D, p, X, q, W' and w are as defined above.

19. A photothermographic color element according to claim 1, wherein the Blocked Developer B is of the following structure:

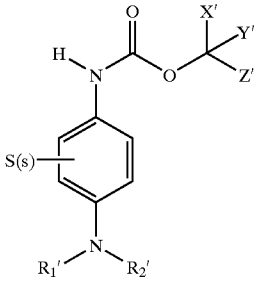

where:

$R_1'$ and $R_2'$ are independently hydrogen or an alkyl group, which may be further substituted, or $R_1'$ and $R_2'$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further substituted or S substituents that are ortho to the $NR_1'R_2'$ substituent can form a heterocyclic ring with $P_1$ or $P_2$; and s is 0 to 4;

X', Y', and Z' represent substituents selected independently from the groups hydrogen, alkyl group of 1 to 6 carbon atoms, cyclopropyl, aryl, arylalkyl, and heterocyclic groups, wherein the cyclopropyl group may be further substituted with an alkyl group of 1 to 6 carbon atoms and the aryl and heterocyclic groups may be in turn substituted with a substituent selected from the group consisting of halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

20. A photothermographic color element according to claim 1, wherein each unit comprises at least one light-sensitive silver halide emulsion, binder, and dye-providing coupler.

21. A photothermographic color element according to claim 1, wherein the imaging element contains at least unit comprising a non-light sensitive silver salt oxidizing agent and a reducing agent.

22. A method of image formation comprising the step of developing a latent image in an imagewise exposed photothermographic color element according to claim 1.

23. A method according to claim 22, wherein development comprises treating said imagewise exposed element at a temperature between about 90° C. and about 180° C. for a time ranging from about 0.5 to about 60 seconds.

24. A method according to claim 22, wherein development comprises treating said imagewise exposed element to a volume of processing solution is between about 0.1 and about 10 times the volume of solution required to fully swell the photographic element.

25. A method according to claim 22, wherein development is accompanied by the application of a laminate sheet containing processing chemicals.

26. A method according to claim 22, wherein the developing is conducted at a processing temperature between about 20° C. and about 100° C.

27. A method according to claim 22, wherein the processing solution comprises aqueous base, aqueous acid, or pure water.

28. A method of image formation comprising the step of scanning an imagewise exposed and developed imaging element according to claim 23 to form a first electronic image representation of said imagewise exposure.

29. A method of image formation comprising the step of digitizing a first electronic image representation formed from an imagewise exposed, developed, and scanned imaging element according to claim 22 to form a digital image.

30. A method of image formation comprising the step of modifying a first electronic image representation formed from an imagewise exposed, developed, and scanned imaging element formulated according to claim 23 to form a second electronic image representation.

31. A method of image formation comprising storing, transmitting, printing, or displaying an electronic image representation of an image derived from an imagewise exposed, developed, scanned imaging element formulated according to claim 22.

32. A method according to claim 31, wherein said electronic image representation is a digital image.

33. A method according to claim 31, wherein printing the image is accomplished with any of the following printing technologies:

Electrophotography;

Inkjet;

Thermal dye sublimation; or

CRT or LED printing to sensitized photographic paper.

34. A photothermographic color element comprising at least three light-sensitive units that have their individual sensitivities in different wavelength regions comprising a silver halide imaging layer having associated therewith a mixture of at least two blocked developing agents comprising Blocked Developer A and Blocked Developer B independently represented by the following structure:

$$\text{DEV-(LINK 1)}_l\text{-(TIME)}_m\text{-(LINK 2)-M}$$

wherein:

DEV is a silver halide color developing agent;

LINK 1 and LINK 2 are linking groups;

TIME is a timing group;

l is 0 or 1;

m is 0, 1, or 2;

n is 0 or 1;

l+n is 1 or 2;

M is a blocking group or M is:

$$\text{-M'-(LINK 2)}_n\text{-(TIME)}_m\text{-(LINK 1)}_l\text{-DEV}$$

wherein M' is blocking group for a second developing agent DEV; and where LINK 1 and LINK 2 have the following structure:

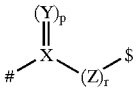

wherein

X represents carbon or sulfur;

Y represents oxygen, sulfur or N—$R_1$, where $R_1$is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2)

wherein the onset temperature of said blocked Developer B is less than the onset temperature of said blocked Developer A, the onset temperature of Developer B is in the range of 110 to 160° C. and the onset temperature of said blocked Developer A is 130 to 170° C. and wherein and the difference in the onset temperatures of the two developing agents are 5 to 50° C., wherein the Blocked Developer A or both Blocked Developer A and B is of the following structure:

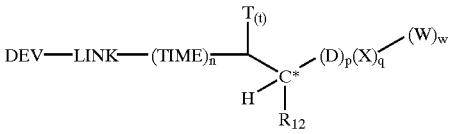

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group); or T is joined with W or $R_{12}$ to form a ring; or two T groups can combine to form a ring;

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group;

W is W' or a group represented by the following structure:

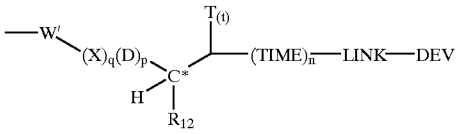

W' is independently selected from a substituted or unsubstituted (referring to the following W' groups) alkyl, cycloalkyl, aryl or heterocyclic group; and wherein W' in combination with T or $R_{12}$ can form a ring;

$R_{13}$, $R_{14}$, $R_{15}$, and $R_{16}$ can independently be selected from substituted or unsubstituted alkyl, aryl, or heterocyclic group; and any two members of the following set: $R_{12}$, T, and either D or W, that are not directly linked may be joined to form a ring, provided that creation of the ring will not interfere with the functioning of the blocking group.

35. A photothermographic color element of claim 34 wherein M in Blocked Developer B is:

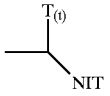

wherein

T represents t independently selected substituted or unsubstituted alkyl or aryl groups, t is 0, 1, or 2 and if t is 2, the T groups can form a ring; and NIT is a disubstituted nitrogen group which optionally can form a ring.

36. A photothermographic color element of claim 34 wherein the Blocked Developer B is of the following structure:

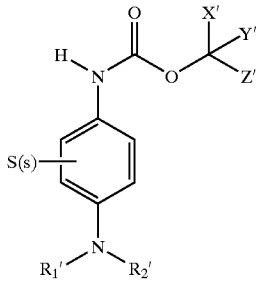

where:

$R_1'$ and $R_1'$ are independently hydrogen or an alkyl group, which may be further substituted, or $R_1'$ and $R_2'$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further substituted or S substituents that are ortho to the $NR_1'R_2'$ substituent can form a heterocyclic ring with $P_1$ or $P_2$; and s is 0 to 4;

X', Y', and Z' represent substituents selected independently from the groups hydrogen, alkyl group of 1 to 6 carbon atoms, cyclopropyl, aryl, arylalkyl, and heterocyclic groups, wherein the cyclopropyl group may be further substituted with an alkyl group of 1 to 6 carbon atoms and the aryl and heterocyclic groups may be in turn substituted with a substituent selected from the group consisting of halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

* * * * *